US011008723B2

(12) United States Patent
Koman

(10) Patent No.: US 11,008,723 B2
(45) Date of Patent: May 18, 2021

(54) OPEN END FRICTION PILE

(71) Applicant: Allentown Infrastructure Group, LLC, Macungie, PA (US)

(72) Inventor: Tiffany L. Koman, Finleyville, PA (US)

(73) Assignee: Allentown Infrastructure Group, LLC, Schnecksville, PA (US)

( * ) Notice: Subject to any disclaimer, the term of this patent is extended or adjusted under 35 U.S.C. 154(b) by 0 days.

(21) Appl. No.: 16/524,990

(22) Filed: Jul. 29, 2019

(65) Prior Publication Data

US 2019/0345686 A1 Nov. 14, 2019

Related U.S. Application Data

(62) Division of application No. 15/609,320, filed on May 31, 2017, now Pat. No. 10,364,542.

(51) Int. Cl.

| | |
|---|---|
| ***E02D 7/06*** | (2006.01) |
| ***E02D 5/28*** | (2006.01) |
| ***E02D 5/22*** | (2006.01) |

(52) U.S. Cl.

CPC ..... *E02D 5/223* (2013.01); *E02D 5/285* (2013.01); *E02D 7/06* (2013.01); *E02D 2200/1642* (2013.01); *E02D 2300/0032* (2013.01)

(58) Field of Classification Search

CPC ..... E02D 5/223; E02D 5/285; E02D 7/06; E02D 2200/1642; E02D 2300/0032

See application file for complete search history.

(56) References Cited

U.S. PATENT DOCUMENTS

| | | | | |
|---|---|---|---|---|
| 1,999,925 A * | 4/1935 | Buzhardt | F16M 11/08 | 248/156 |
| 4,269,010 A * | 5/1981 | Glass | E04H 17/08 | 52/154 |
| 4,966,499 A * | 10/1990 | St. Louis | E02D 3/02 | 37/904 |
| 5,123,623 A * | 6/1992 | McNamara | E04H 12/2253 | 248/156 |
| 6,561,736 B1 * | 5/2003 | Doleshal | E02D 27/52 | 405/211 |
| 6,871,455 B1 * | 3/2005 | Cockman et al. | E02D 5/801 | 135/118 |

(Continued)

FOREIGN PATENT DOCUMENTS

| | | | |
|---|---|---|---|
| CA | 2980658 A1 * | 3/2018 | E04H 12/2276 |
| WO | WO-2016187615 A1 * | 11/2016 | E02D 27/32 |

*Primary Examiner* — Tara Mayo-Pinnock
(74) *Attorney, Agent, or Firm* — Design IP

(57) ABSTRACT

The Open End Friction Pile comprises of four steel plates, four brackets, and one driving head. The steel plates have a first bend line and a second bend line that are equidistant from a distal end. The first bend line and second bend line of the steel plates are equidistant from each other creating a center portion. The brackets have a first bend line and a second bend line that are equidistant from a distal end. The first bend line and second bend line of the brackets are equidistant from each other creating a center portion. The bracket has a third bend line along the center portion. One bracket is connected to one steel plate along the distal ends and center portion. All four steel plates and four brackets concurrently connect along the distal ends to form two open-ends. A driving head is connected covering the top open-end.

15 Claims, 27 Drawing Sheets

(56) References Cited

U.S. PATENT DOCUMENTS

| | | | | |
|---|---|---|---|---|
| 7,354,224 | B2 * | 4/2008 | Cinquano | E02D 5/16 405/250 |
| 7,823,347 | B1 * | 11/2010 | Blinn | E04C 3/08 52/244 |
| 2014/0356076 | A1 * | 12/2014 | Hale et al. | E02D 5/54 405/255 |
| 2016/0168816 | A1 * | 6/2016 | Pope | E02D 5/223 52/292 |
| 2017/0284120 | A1 * | 10/2017 | White | E04H 12/2215 |

* cited by examiner

OPEN END FRICTION PILE

CROSS REFERENCE TO RELATED APPLICATIONS

Not Applicable

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable

BACKGROUND OF THE INVENTION

The present invention pertains to supporting tall commercial structures. The present invention supports commercial structures such as utility poles in the transmission industry and lattice towers in the cellular industry. The present invention is an alternative solution to one or several reinforced drilled concrete caissons as supports for the pole or tower. A reinforced drilled concrete caisson is a foundation support to resist the load requirements of the pole or tower which is based on the applicable soil analysis. The load requirements are the various amounts of TONS that the pole or tower can withstand before it sinks, pulls out of the ground, falls over, or twists. A soil analysis is a boring log where an auger drills to a depth and core samples of the soil can be withdrawn for analysis. This analysis will determine if the soil is loose or dense, wet or dry, clay or sand, gravel-filled or impenetrable rock. Based on the load requirements and soil analysis, a reinforced drilled concrete caisson is designed. The reinforced drilled concrete caisson requires an excavator to remove the soil, a rock hammer if rock is detected from the analysis, a backhoe to carry the displaced soil to a dump truck or move to another location, one or several dump trucks to haul away the soil, delivery trucks with the reinforced rebar, a crane to lift the rebar for tying and installation and the anchor bolt cage, one or several concrete trucks that must deliver the concrete within the one-hour time restriction before the integrity and strength is compromised, a backhoe to backfill the specific soil combination, ground equipment to compact the concrete or backfill, a minimum of 7-10 operators and laborers, and at least 21 days of flawless weather, climate, and terrain to complete the caisson construction.

BRIEF SUMMARY OF THE INVENTION

The Open End Friction Pile is designed to resist the same load requirements and soil analysis as the reinforced drilled concrete caisson. However, there are several distinguishable advantages of the Open End Friction Pile over the reinforced drilled concrete caisson. First the present invention's driving head embodiment was designed around the Mobilram system. With an average set up time of 30 minutes for specialized pile driving, its compact one-load transporting unit, 800 HP of operation, 157 TONS of driving force, accuracy, and overall installation speed, accompanied with the Open End Friction Pile, provide a distinct advantage of one-day rapid installation over the current 21 day reinforced drilled concrete caisson installation. The present invention does not remove any soil, therefore a backhoe, dump truck, or related operators and laborers are not needed. The present invention does not use rebar, therefore, a crane, operator, and related laborers are not needed. The present invention does not use concrete, therefore, dump trucks, ground equipment, and related laborers are not needed. There is not a safety risk of ineffective strength tests or curing due to concrete transportation issues when project locations are away from commercial highways or roads. The present invention does not require favorable weather or climate conditions. The present invention can be installed in any weather climate condition from below freezing to three-digit temperatures. The present invention is comprised of all steel. Unlike concrete, which requires additional additives to the concrete mixture or water tanks on site to keep the concrete workable, the present invention arrives to the project site immediately ready for installation.

An advantage of the present invention is the simplified quality assurance checklist for procurement. A steel mill moves the steel, and applicable mill certifications, to the manufacturer. The ISO certified manufacturer cuts, squares, bends, and assembles the steel to form the present invention. A one-stop shop. When compared to concrete plants, chemical plants, mixing plants, and batch plants the excessive quality assurance checklists increase with each product movement.

An advantage of the present invention is the ability to conduct an installation in any weather or climate condition. The present invention is not weather dependent.

An advantage of the present invention is the ability to conduct an installation in any soil condition, i.e. Loose or dense, wet or dry, clay, sand or weathered rock. The present invention has an open-end with tapered sides for displacing the soil. Combined with the method of installation, the present invention allows for penetration in up to four (4) feet of rock with a Rock Quality Designation of forty (40) percent or less.

An advantage of the present invention is the installation speed. With the driving head embodiment attached, the present invention arrives to the project site ready for immediate installation. The Mobilram used to install the present invention has an average set-up time of 30 minutes. Within the hour, the Mobilram will connect to the driving head of the present invention, lift the present invention off of the delivery truck flat bed and begin installation. There is no excavation or digging required for the installation of the present invention. The present invention can be installed in one working day. The utility pole or lattice tower can be installed immediately. There is no waiting or lengthy curing times.

An advantage of the present invention is the reduced manpower on the project site. The present invention can be installed in one working day with a minimum crew of three (3) people. On the job site with less manpower on the project site, there is less potential for a safety issue. There is less wasted down time between steps in the process. Overall, there is less expense.

An advantage of the present invention is the effectiveness to resist the load requirement of compression force. The present inventions open-end and method of installation when inserted into the ground creates suction or plugging in the interior of the open-end. This suction or plugging is the allowable skin friction to resist the load requirement of compression force.

An advantage of the present invention is a cost-effective solution when compared to reinforced drilled concrete caissons for the transmission and cellular industries. Carbon plate steel and structural bolts are the only products used for the present invention. The carbon plate steel and structural bolts are widely available from within the United States and abroad.

In the first embodiment of the present invention discloses a first, single plate of steel having a first bend line from a distal end and a second bend line from a distal end creating a center portion. The first bend line from a distal end and second bend line from a distal end are equidistant from the center portion. The center portion is equal to the sum of the distal end from the first bend line and from the distal end of the second bend line.

In a second embodiment of the present invention discloses a second, single plate of steel having a first bend line from a distal end and a second bend line from a distal end creating a center portion. The first bend line from a distal end and second bend line from a distal end are equidistant from the center portion. The center portion is equal to the sum of the distal end from the first bend line and from the distal end of the second bend line.

In a third embodiment of the present invention discloses a third, single plate of steel having a first bend line from a distal end and a second bend line from a distal end creating a center portion. The first bend line from a distal end and second bend line from a distal end are equidistant from the center portion. The center portion is equal to the sum of the distal end from the first bend line and from the distal end of the second bend line.

In a fourth embodiment of the present invention discloses a fourth, single plate of steel having a first bend line from a distal end and a second bend line from a distal end creating a center portion. The first bend line from a distal end and second bend line from a distal end are equidistant from the center portion. The center portion is equal to the sum of the distal end from the first bend line and from the distal end of the second bend line.

In a fifth embodiment of the present invention discloses a first bracket with a flap made from a fifth, single plate of steel having a first bend line from a distal end and a second bend line from a distal end creating a center portion. The first bend line from a distal end and second bend line from a distal end are equidistant from the center portion. The center portion is equal to the sum of the distal end from the first bend line and from the distal end of the second bend line. A third bend line spans along the center portion between the first and second bend lines. The third bend line from the center portion allows for the flap. Gussets connect the center portion between the first and second bend lines and the flap between the first and second bend lines.

In a sixth embodiment of the present invention discloses a second bracket with a flap made from a sixth, single plate of steel having a first bend line from a distal end and a second bend line from a distal end creating a center portion. The first bend line from a distal end and second bend line from a distal end are equidistant from the center portion. The center portion is equal to the sum of the distal end from the first bend line and from the distal end of the second bend line. A third bend line spans along the center portion between the first and second bend lines. The third bend line from the center portion allows for the flap. Gussets connect the center portion between the first and second bend lines and the flap between the first and second bend lines.

In a seventh embodiment of the present invention discloses a third bracket with a flap made from a seventh, single plate of steel having a first bend line from a distal end and a second bend line from a distal end creating a center portion. The first bend line from a distal end and second bend line from a distal end are equidistant from the center portion. The center portion is equal to the sum of the distal end from the first bend line and from the distal end of the second bend line. A third bend line spans along the center portion between the first and second bend lines. The third bend line from the center portion allows for the flap. Gussets connect the center portion between the first and second bend lines and the flap between the first and second bend lines.

In an eighth embodiment of the present invention discloses a fourth bracket with a flap made from a eighth, single plate of steel having a first bend line from a distal end and a second bend line from a distal end creating a center portion. The first bend line from a distal end and second bend line from a distal end are equidistant from the center portion. The center portion is equal to the sum of the distal end from the first bend line and from the distal end of the second bend line. A third bend line spans along the center portion between the first and second bend lines. The third bend line from the center portion allows for the flap. Gussets connect the center portion between the first and second bend lines and the flap between the first and second bend lines.

In a ninth embodiment of the present invention discloses a driving head made from a ninth, circular plate of steel with an h-beam connected to the center of the circular steel plate.

BRIEF DESCRIPTION OF THE SEVERAL VIEWS OF THE DRAWING

FIG. 13, FIG. 14, and FIG. 15.

DETAILED DESCRIPTION OF THE INVENTION

The following discussion of the embodiments of the present invention it is to be understood that the invention can assume various alternative orientations. It is further understood that the invention is not limited to the application details since the invention is capable of alternative orientations.

Figure 1:
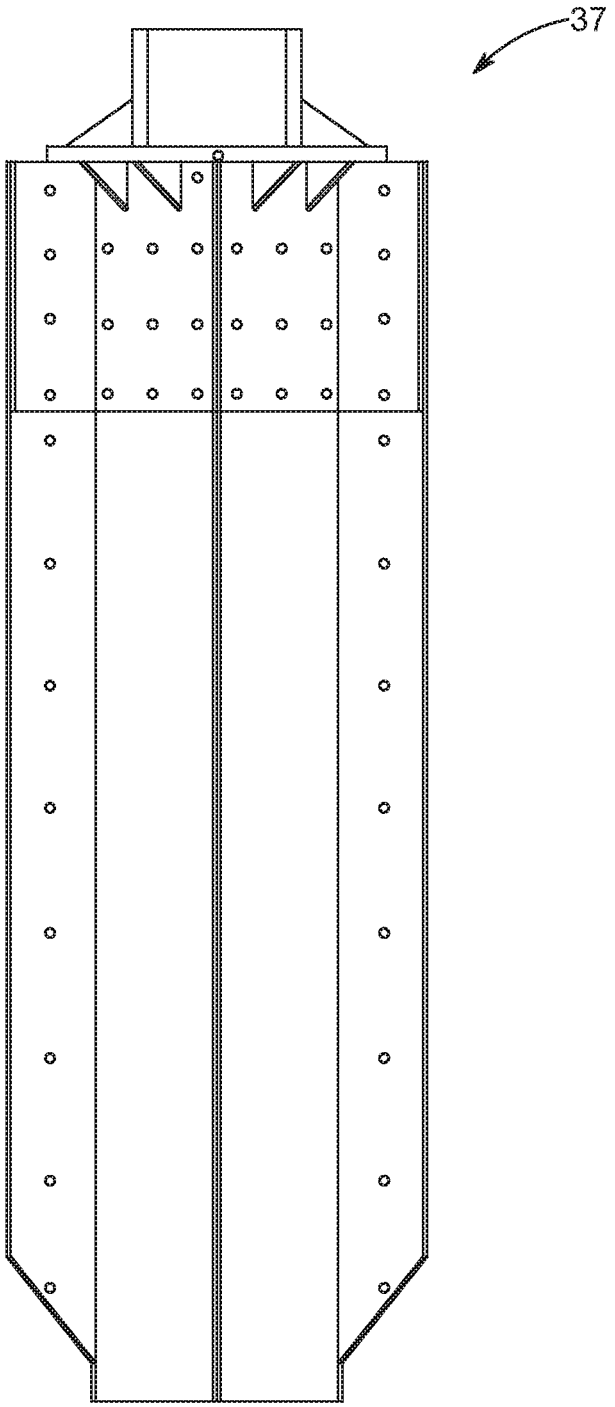
FIG. 1 is a perspective view of the Open End Friction Pile 37 according to the embodiments of the present invention.

FIG. 1 illustrates the Open End Friction Pile 37 that pertains to tall commercial structures such as utility poles in the transmission industry and lattice towers in the cellular industry where the utility pole or lattice tower requires drilled reinforced concrete caissons to resist the load requirements based on applicable soil analysis.

Figure 2:
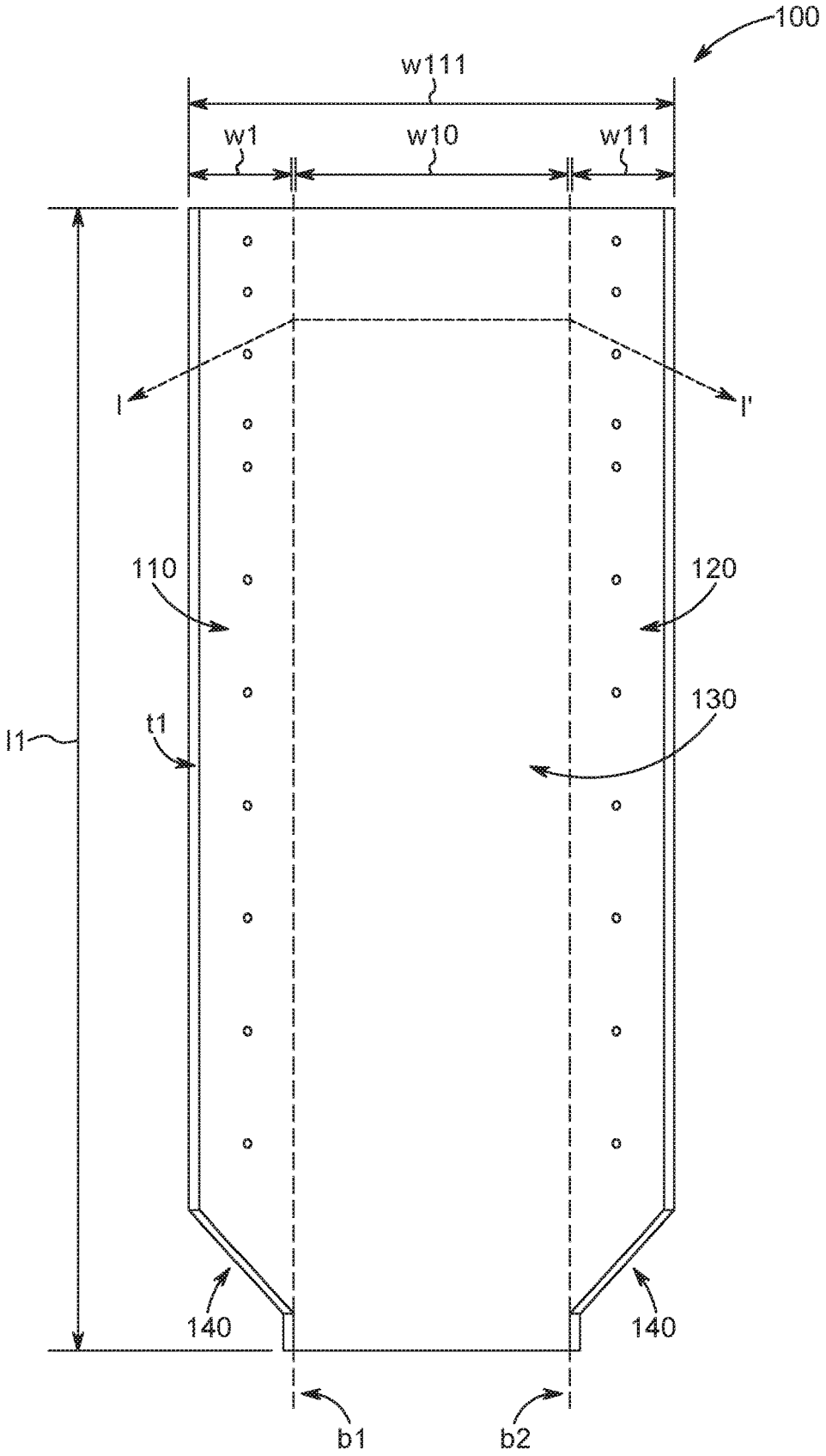
FIG. 2 is a front view of the steel plate 100 according to FIG. 1.

FIG. 2 illustrates the front view of steel plate 100 according to FIG. 1. The width w1 from the first bend line b1 from distal end 110 and the width w11 from the second bend line b2 from distal end 120 are equidistant. The width w10 of the center portion 130 of steel plate 100 is equal to the sum of the width of w1 and w11. At the bottom of the steel plate 100 the sides 140 of distal end 110 and 120 are tapered. The tapered sides 140 are important for driving the Open End Friction Pile 37 into weathered rock or limestone. Bend lines b1 and b2 are formed by placing steel plate 100 into a press brake. A press brake can use up to 750 TON to bend the embodiment. The width w1 of steel plate 100 can range from five inches to forty-eight inches. The width w11 of steel plate 100 can range from five inches to forty-eight inches. The width w10 of center portion 130 can range from ten inches to ninety-six inches. The length l1 of steel plate 100 can range from six feet to fifty feet. The thickness t1 of steel plate 100 can range from 0.375 inches to 1.5 inches. The width w111, length l1 and thickness t1 are all determined by the utility pole or lattice towers structural load requirements and the soil analysis provided by geotechnical engineers. This criteria is entered in a computer software utilizing a finite element to determine if there is stress to the Open End Friction Pile 37. Should the data determine stress, the width w111, length l1 and thickness t1 of steel plate 100 are increased or decreased. The updated Open End Friction Pile 37 width w111, length l1 and thickness t1 of steel plate 100 are entered and re-entered into the software until the structural engineer determines the final dimensions are sufficient to resist the load requirements with the applicable factor of safety.

Figure 3:
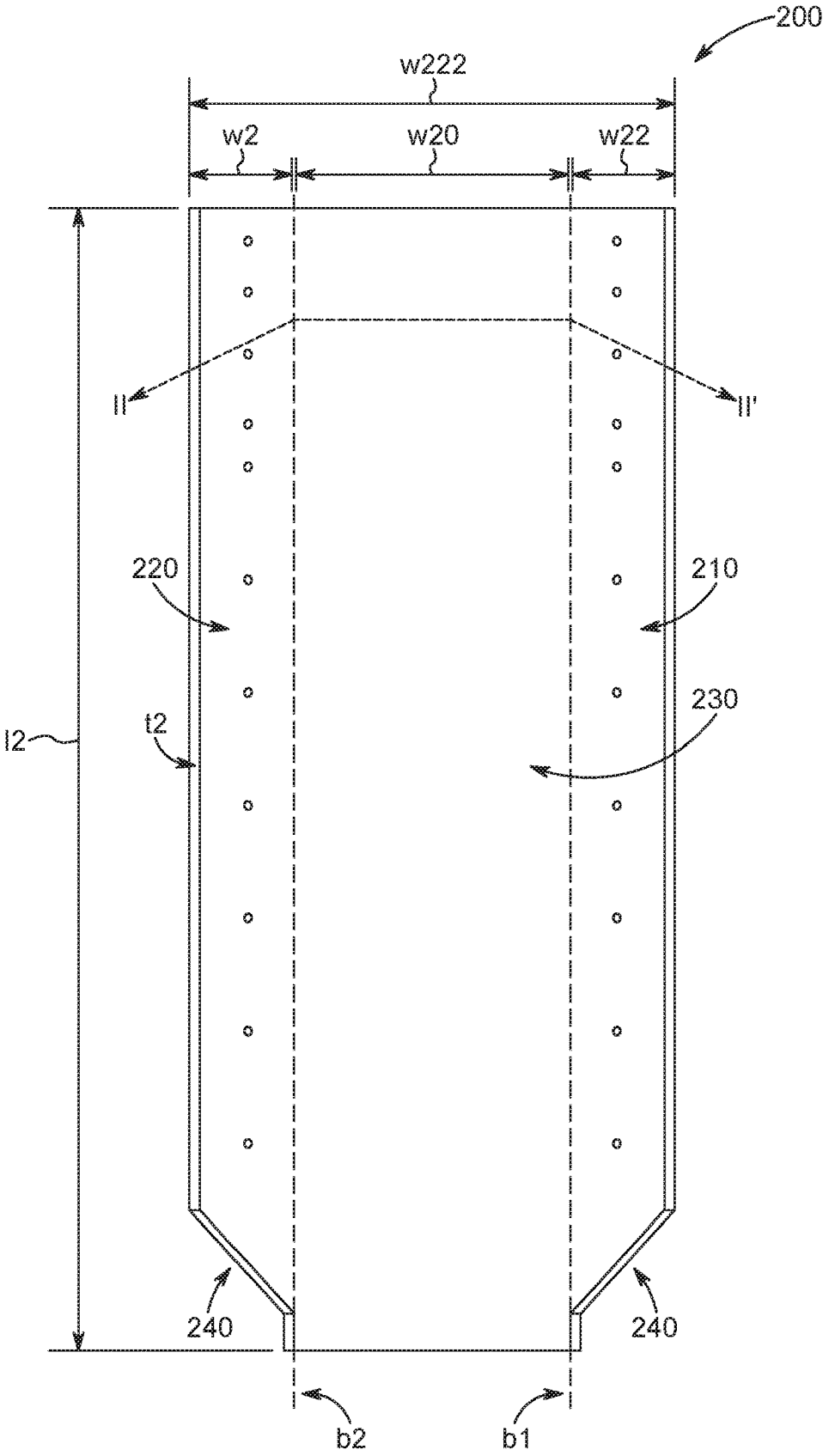
FIG. 3 is a front view of the steel plate 200 according to FIG. 1.

FIG. 3 illustrates the front view of steel plate 200 according to FIG. 1. The width w2 from the second bend line b2 from distal end 220 and the width w22 from the first bend line b2 from distal end 210 are equidistant. The width w20 of the center portion 230 of steel plate 200 is equal to the sum of the width of w2 and w22. At the bottom of the steel plate 200 the sides 240 of distal end 210 and 220 are tapered. The tapered sides 240 are important for driving the Open End Friction Pile 37 into weathered rock or limestone. Bend lines b1 and b2 are formed by placing steel plate 200 into a press brake. A press brake can use up to 750 TON to bend the embodiment. The width w2 of steel plate 200 can range from five inches to forty-eight inches. The width w22 of steel plate 200 can range from five inches to forty-eight inches. The width w20 of center portion 230 can range from ten inches to ninety-six inches. The length l2 of steel plate 200 can range from six feet to fifty feet. The thickness t2 of steel plate 200 can range from 0.375 inches to 1.5 inches. The width w222, length l2 and thickness t2 are all determined by the utility pole or lattice towers structural load requirements and the soil analysis provided by geotechnical engineers. This criteria is entered in a computer software utilizing a finite element to determine if there is stress to the Open End Friction Pile 37. Should the output of the data determine stress, the width w222, length l2 and thickness t2 of steel plate 200 are increased or decreased. The updated Open End Friction Pile 37 width w222, length l2 and thickness t2 of steel plate 200 are entered and re-entered into the software until the structural engineer determines the final dimensions are sufficient to resist the load requirements with the applicable factor of safety.

Figure 4:
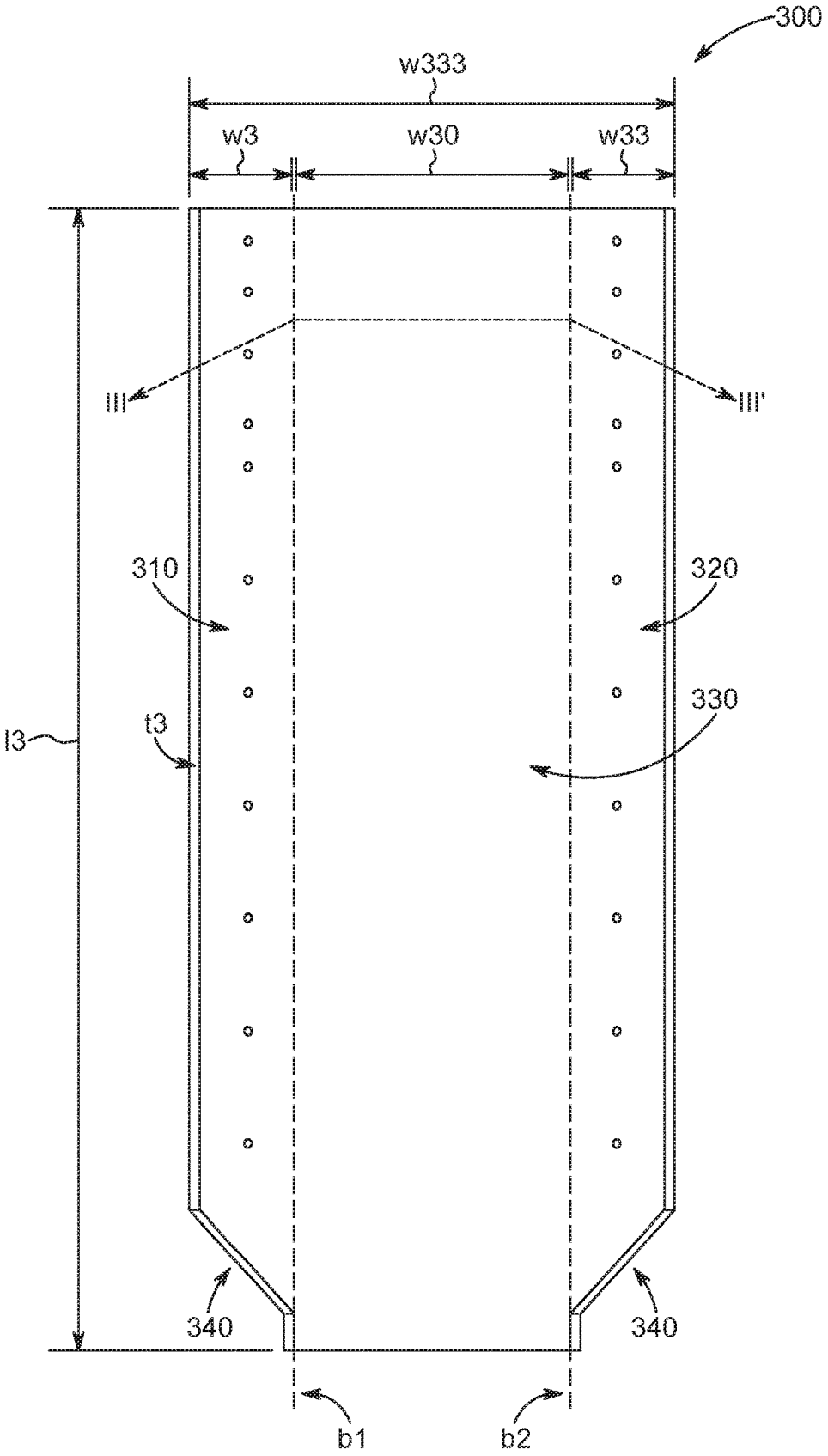
FIG. 4 is a front view of the steel plate 300 according to FIG. 1.

FIG. 4 illustrates the front view of steel plate 300 according to FIG. 1. The width w3 from first bend line b1 from distal end 310 and the width w33 from second bend line b2 from distal end 320 are equidistant. The width w30 of the center portion 330 of steel plate 300 is equal to the sum of the width of w3 and w33. At the bottom of the steel plate 300 the sides 340 of distal end 310 and 320 are tapered. The tapered sides 340 are important for driving the Open End Friction Pile 37 into weathered rock or limestone. Bend lines b1 and b2 are formed by placing steel plate 300 into a press brake. A press brake can use up to 750 TON to bend the embodiment. The width w3 of steel plate 300 can range from five inches to forty-eight inches. The width w33 of steel plate 300 can range from five inches to forty-eight inches. The width w30 of center portion 330 can range from ten inches to ninety-six inches. The length 13 of steel plate 300 can range from six feet to fifty feet. The thickness t3 of steel plate 300 can range from 0.375 inches to 1.5 inches. The width w333, length 13 and thickness t3 are all determined by the utility pole or lattice towers structural load requirements and the soil analysis provided by geotechnical engineers. This criteria is entered in a computer software utilizing a finite element to determine if there is stress to the Open End Friction Pile 37. Should the output of the data determine stress, the width w333, length 13 and thickness t3 of steel plate 300 are increased or decreased. The updated Open End Friction Pile 37 width w333, length 13 and thickness t3 of steel plate 300 are entered and re-entered into the software until the structural engineer determines the final dimensions are sufficient to resist the load requirements with the applicable factor of safety.

Figure 5:
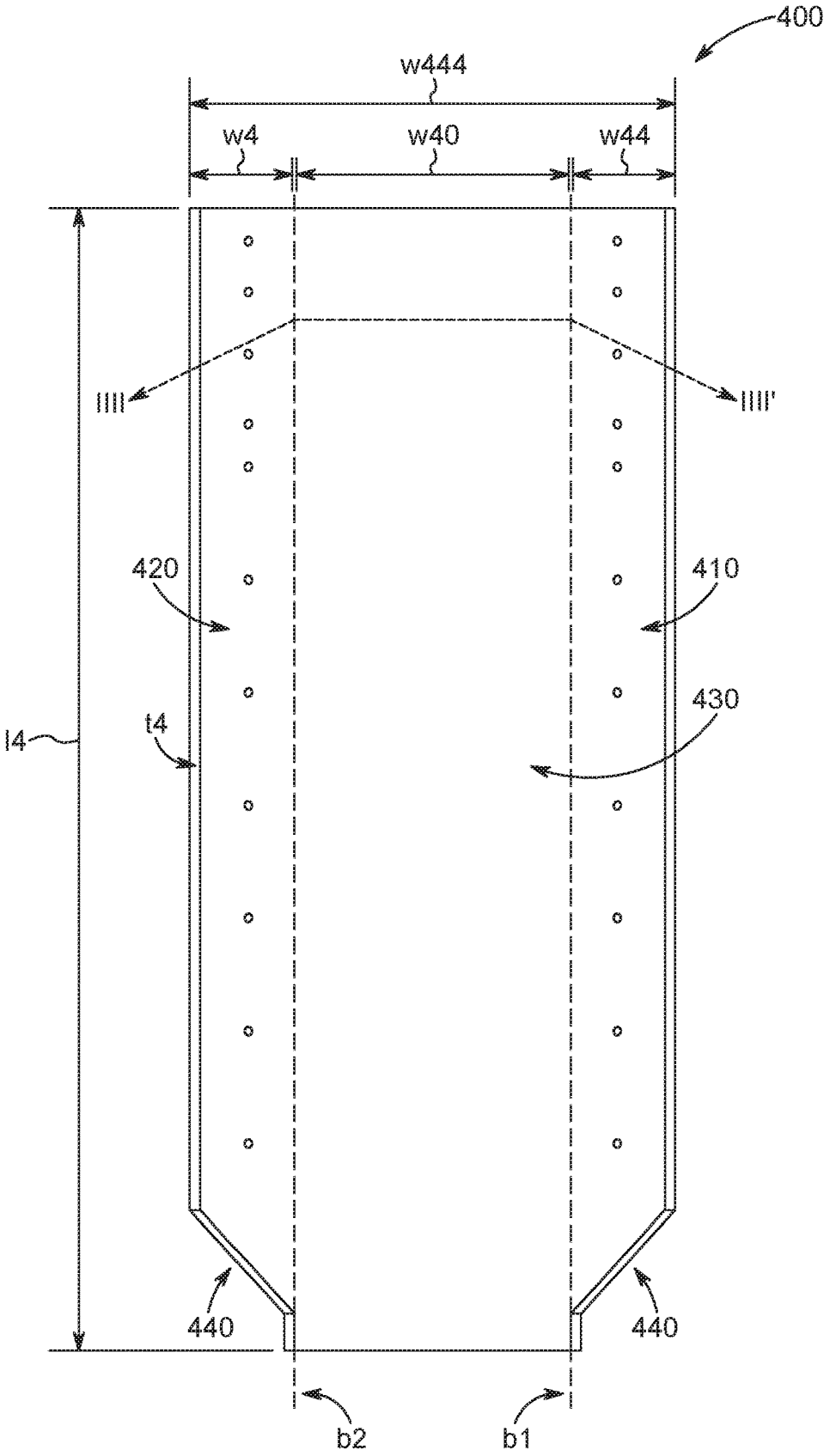
FIG. 5 is a front view of the steel plate 400 according to FIG. 1.

FIG. 5 illustrates the front view of steel plate 400 according to FIG. 1. The width w4 from first bend line b1 from distal end 410 and the width w44 from second bend line b2 from distal end 420 are equidistant. The width w40 of the center portion 430 of steel plate 400 is equal to the sum of the width of w4 and w44. At the bottom of the steel plate 400 the sides 440 of distal end 410 and 420 are tapered. The tapered sides 440 are important for driving the Open End Friction Pile 37 into weathered rock or limestone. Bend lines b1 and b2 are formed by placing steel plate 400 into a press brake. A press brake can use up to 750 TON to bend the embodiment. The width w4 of steel plate 400 can range from five inches to forty-eight inches. The width w44 of steel plate 400 can range from five inches to forty-eight inches. The width w40 of center portion 430 can range from ten inches to ninety-six inches. The length 14 of steel plate 400 can range from six feet to fifty feet. The thickness t4 of steel plate 400 can range from 0.375 inches to 1.5 inches. The width w444, length 14 and thickness t4 are all determined by the utility pole or lattice towers structural load requirements and the soil analysis provided by geotechnical engineers. This criteria is entered in a computer software utilizing a finite element to determine if there is stress to the Open End Friction Pile 37. Should the output of the data determine stress, the width w444, length 14 and thickness t4 of steel plate 400 are increased or decreased. The updated Open End Friction Pile 37 width w444, length 14 and thickness t4 of steel plate 400 are entered and re-entered into the software until the structural engineer determines the final dimensions are sufficient to resist the load requirements with the applicable factor of safety.

Figure 6:
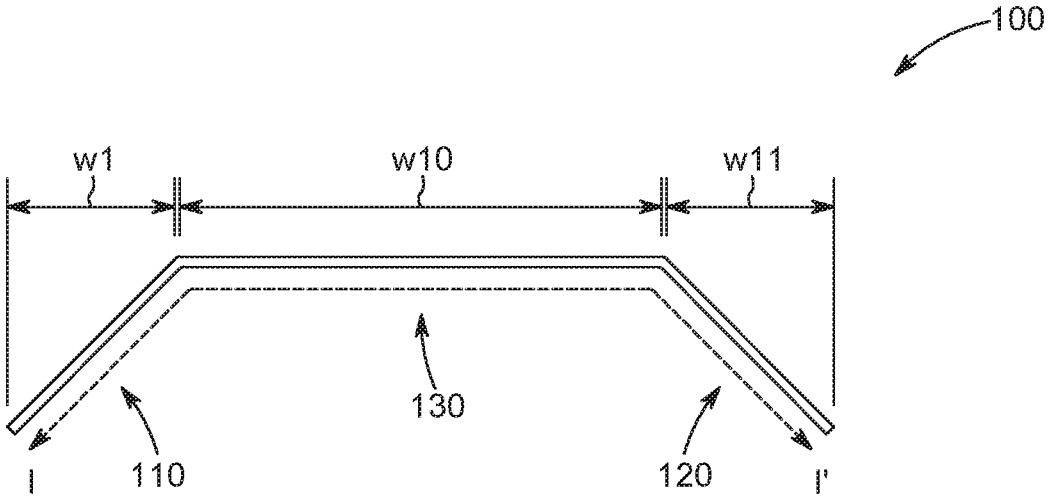
FIG. 6 is a cross-sectional view of according to FIG. 2.

FIG. 6 is a cross-sectional view of steel plate 100, taken along line I-I' of FIG. 2. FIG. 6 illustrates the first bend line b1 from distal end 110 and the second bend line b2 from distal end 120 and how bend line b1 and bend line b2 are equidistant from the center 130.

Figure 7:
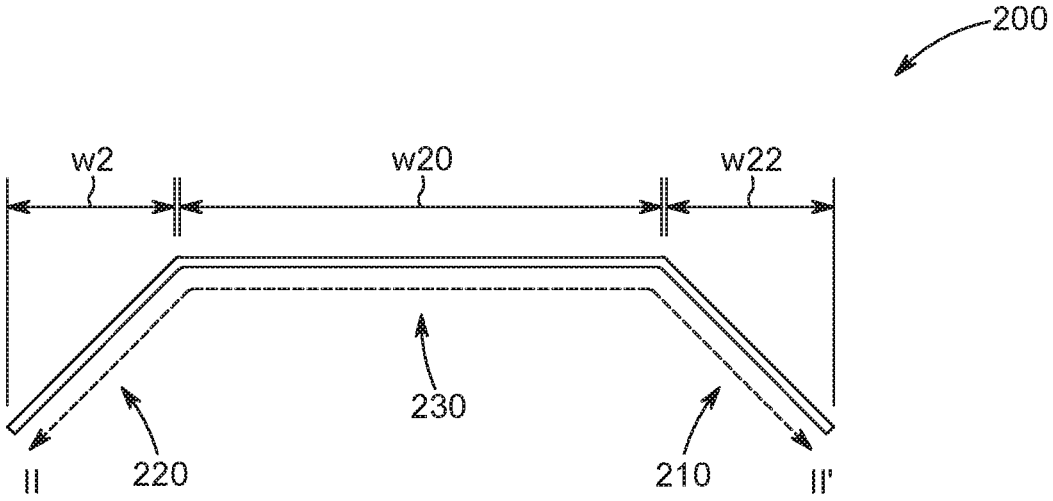
FIG. 7 is a cross-sectional view of according to FIG. 3.

FIG. 7 is a cross-sectional view of steel plate 200, taken along line II-IF of FIG. 3. FIG. 7 illustrates the second bend line b2 from distal end 220 and the first bend line b1 from distal end 210 and how bend line b2 and bend line b1 are equidistant from the center 230.

Figure 8:
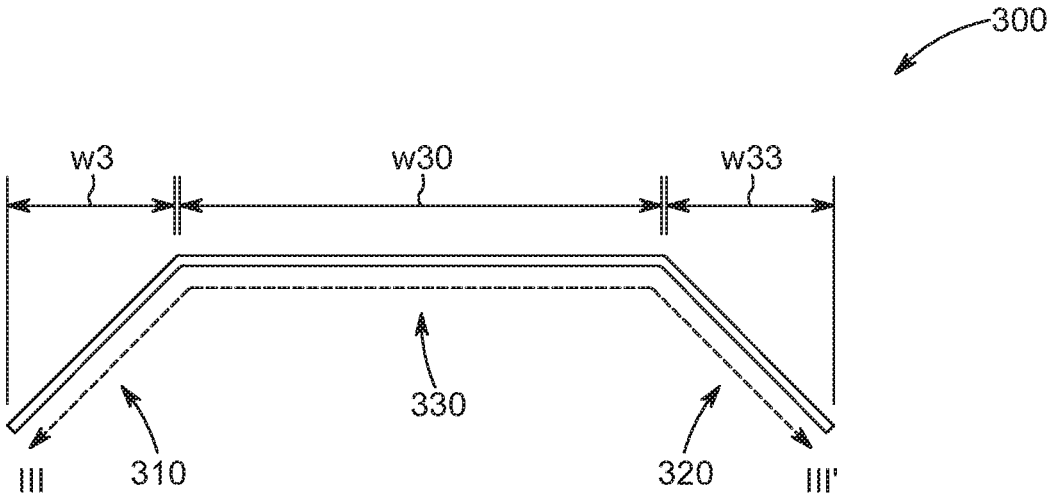
FIG. 8 is a cross-sectional view of according to FIG. 4.

FIG. 8 is a cross-sectional view of steel plate 300, taken along line of FIG. 4. FIG. 8 illustrates the first bend line b1 from distal end 310 and the second bend line b2 from distal end 320 and how bend line b1 and bend line b2 are equidistant from the center 330.

Figure 9:
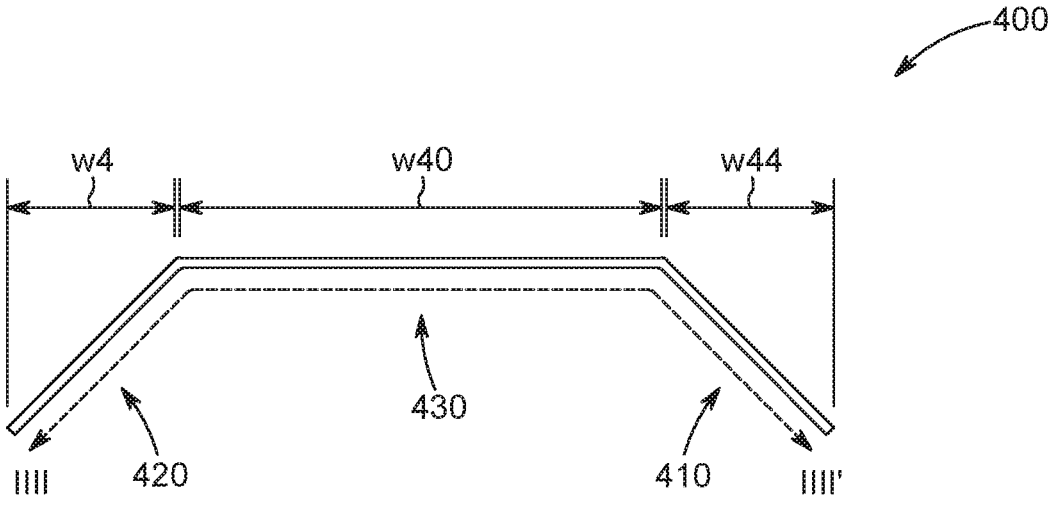
FIG. 9 is a cross-sectional view of according to FIG. 5.

FIG. 9 is a cross-sectional view of steel plate 400, taken along line 1111-1111' of FIG. 5. FIG. 9 illustrates the second bend line b2 from distal end 420 and the first bend line b1 from distal end 410 and how bend line b1 and bend line b2 are equidistant from the center 430.

Figure 10:
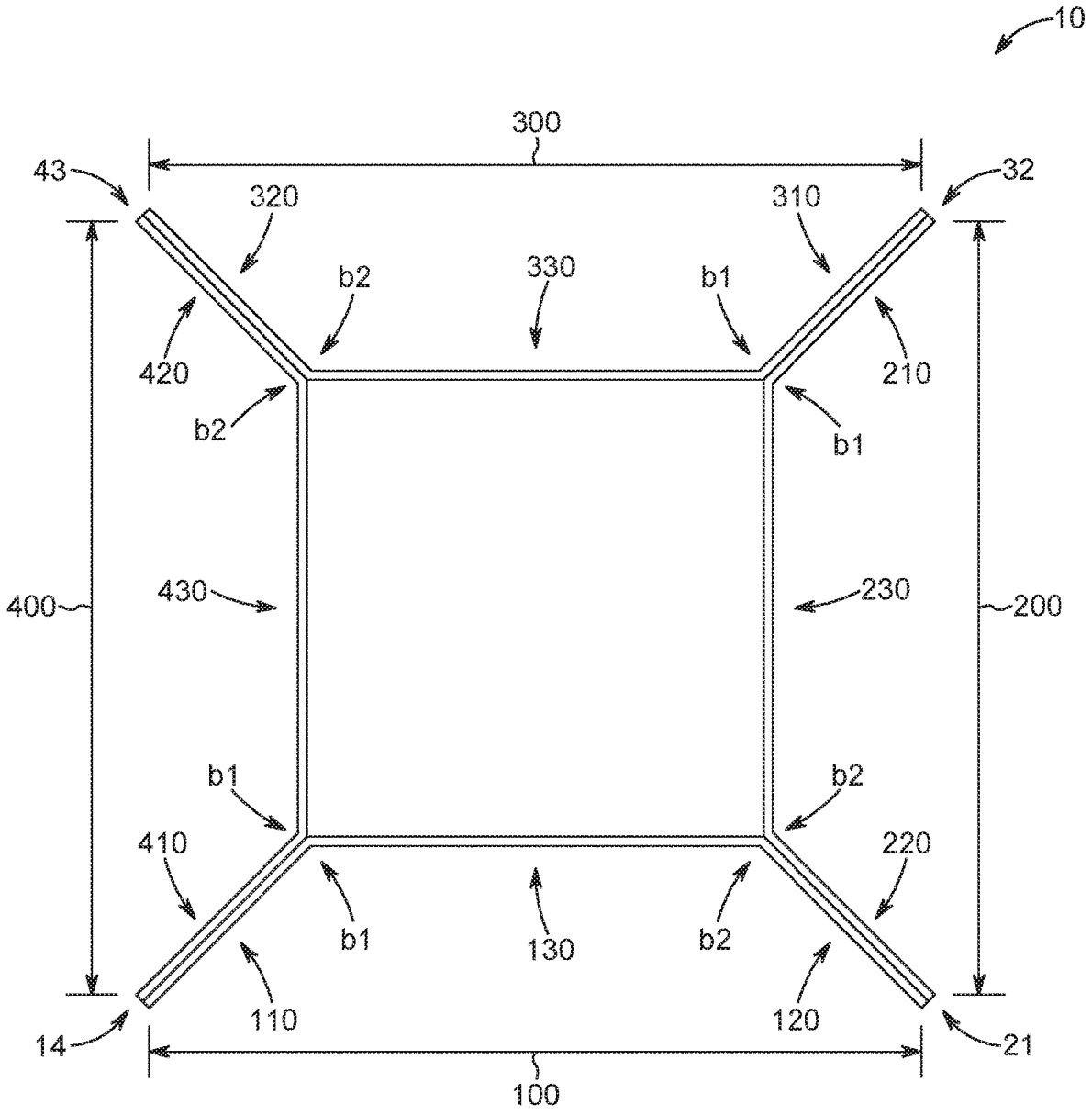
FIG. 10 is a top perspective view 10 according to FIG. 6, FIG. 7, FIG. 8, and FIG. 9.

FIG. 10 is a top perspective view 10 according to FIG. 6, FIG. 7, FIG. 8, and FIG. 9. FIG. 10 illustrates how distal end 110 of steel plate 100 is only connected and flush with distal end 410 of steel plate 400 creating side 14. FIG. 10 illustrates how distal end 420 of steel plate 400 is only connected and flush with distal end 320 of steel plate 300 creating side 43. FIG. 10 illustrates how distal end 310 of steel plate 300 is only connected and flush with distal end 210 of steel plate 200 creating side 32. FIG. 10 illustrates how distal end 220 of steel plate 200 is only connected and flush with distal end 120 of steel plate 100 creating side 21.

Figure 11:
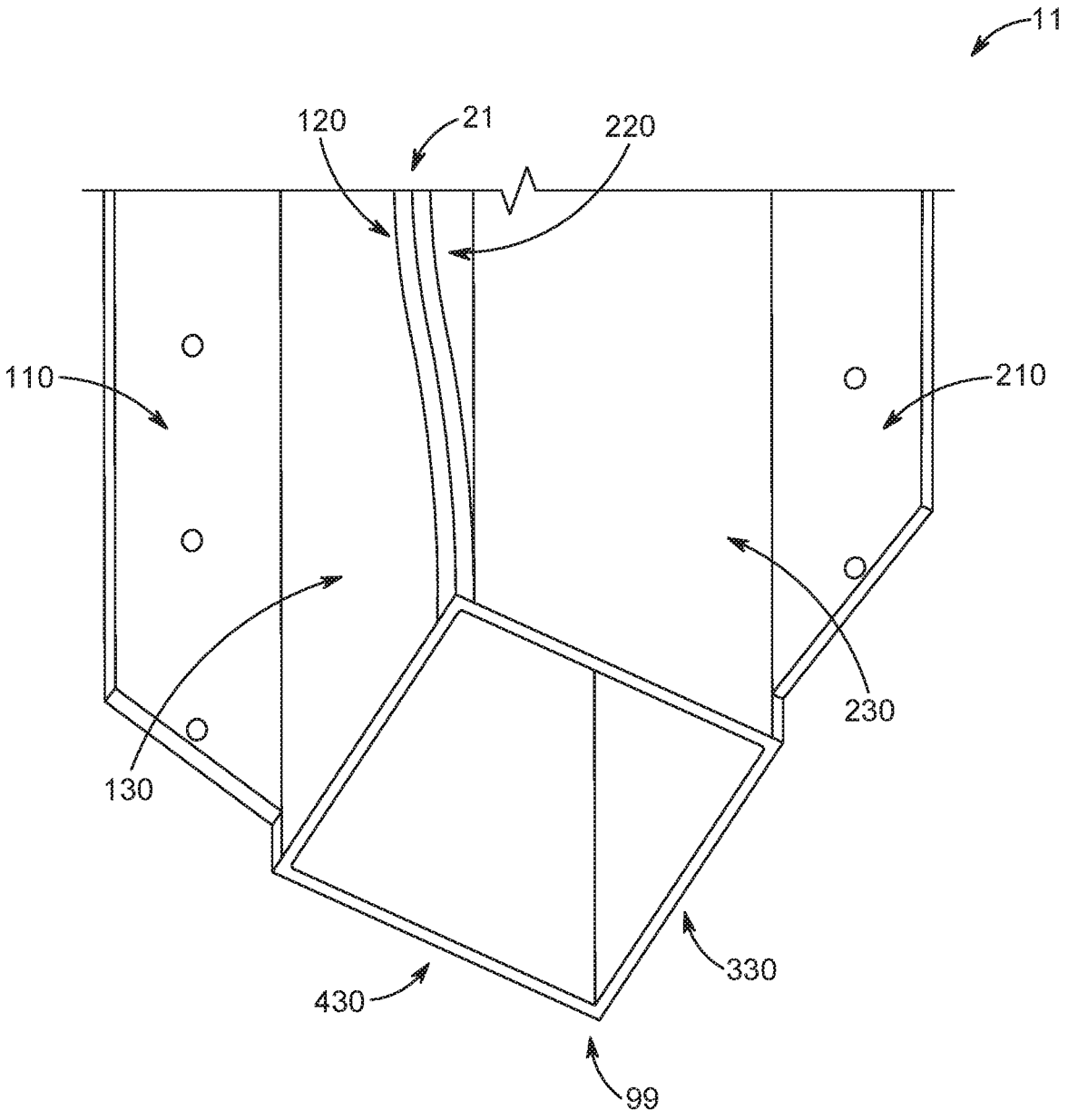
FIG. 11 is a bottom perspective view 11 according to FIG. 10.

FIG. 11 is a bottom perspective view 11 according to FIG. 10. By the distal ends making their respective connections allows for the open-end portion 99 of the Open End Friction Pile 37. The open-end portion 99 causes soil plugging when the Open End Friction Pile 37 is installed by a Mobilram that hydraulically pushes and vibrates at the same time. When the present invention is driven into the ground, soil enters the inside of the Open End Friction Pile 37. If the pile penetration depth is equal to the soil plug length, this behavior is typically referred to as "fully coring". As the pile is driven deeper into the soil, the soil friction on the inside of the pile wall increases until a "soil plug" is formed, which results in significant compression strength. The present invention utilizes this compression strength to resist the load requirements of the utility pole or lattice tower.

Figure 12:
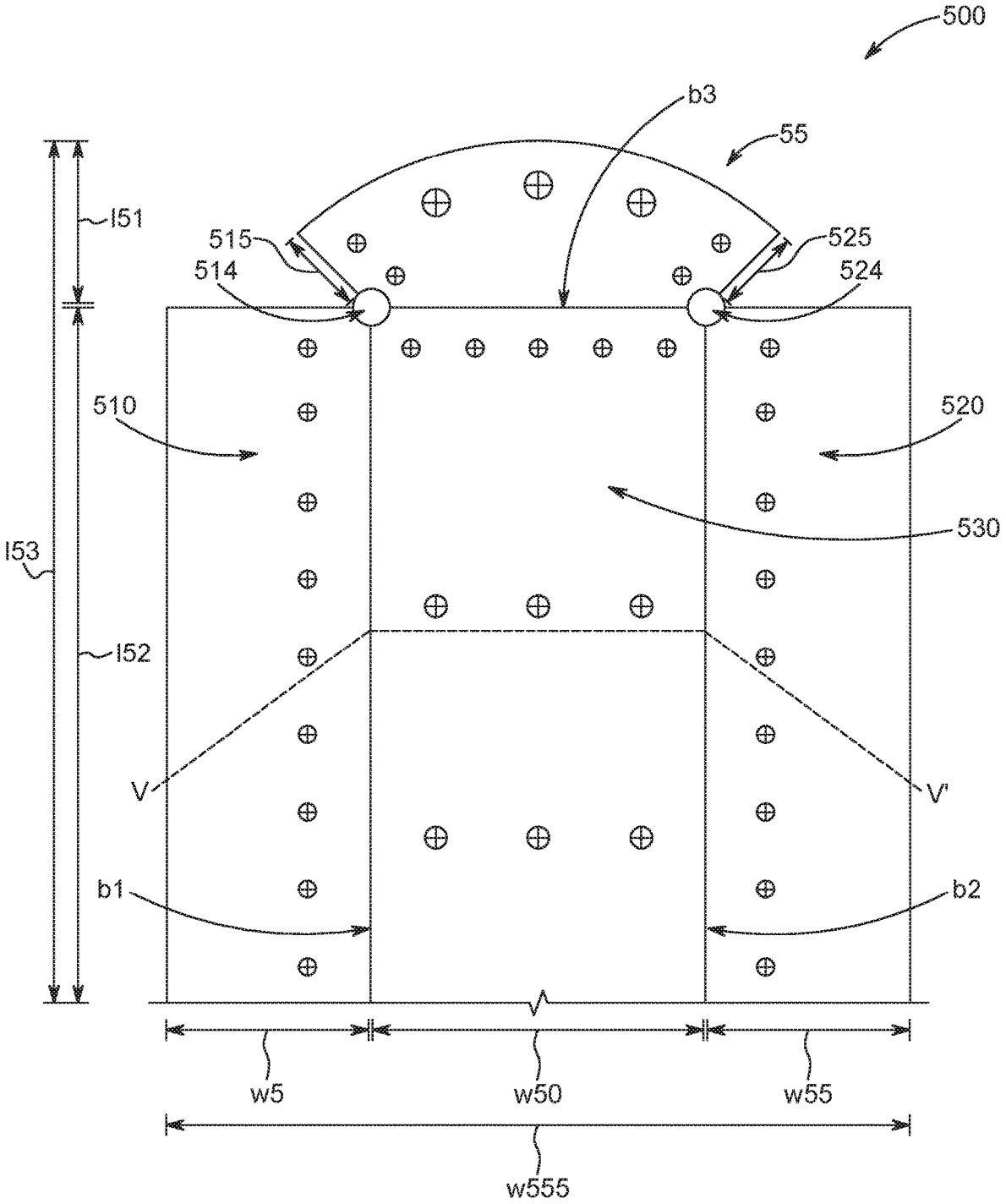
FIG. 12 is a front flat view of the bracket with a flap 500.

FIG. 12 is a flat front perspective view of the bracket with a flap 500. The width w5 of distal end 510 from the first bend line b1 is equal to the width w55 of distal end 520 from the second bend line b2. Bend line b1 and bend line b2 are equidistant from the center portion 530. The width w50 of center portion 530 is equal to the sum of width w5 and width w55. Width w5 of distal end 510 is equal to width w1 of distal end 110 of steel plate 100. Width w55 of distal end 520 is equal to width w11 of distal end 120 of steel plate 100. Width w50 of center portion 530 is equal to the width of w10 of center portion 130 of steel plate 100. Width w555 of bracket with a flap 500 is equal to the width w111 of steel plate 100. The length 152 ranges from twenty-four inches to forty-eight inches. The length 151 ranges from twelve inches to forty-eight inches. The length 153 is equal to the sum of length 152 and length 151. When the bracket with flap 500 is bent on bend line b3, the flap portion 55 is created. The flap portion 55 extends perpendicular to center line 530. Distal end 515 of the flap portion 55 is connected at the intersection of corner 514 of center portion 530 and distal end 510 from the first bend line b1. The length of distal end 515 is determined by the arc of flap portion 55. Distal end 525 of the flap portion 55 is connected at the intersection of corner 524 of center portion 530 and distal end 520 from the second bend line b2. The length of distal end 525 is determined by the arc of flap portion 55. The bracket with a flap 500 reinforces the top of steel plate 100. Engineering reports determined that the top four feet of the Open End Friction Pile 37 carry the majority of the structural stress. Therefore, it was imperative to reinforce steel plate 100 with the bracket with a flap 500 to reduce or remove structural stress. The flap portion 55 is used for connecting the driving head 24 for installation and also for the top structure connection to the Open End Friction Pile 37.

Figure 13:
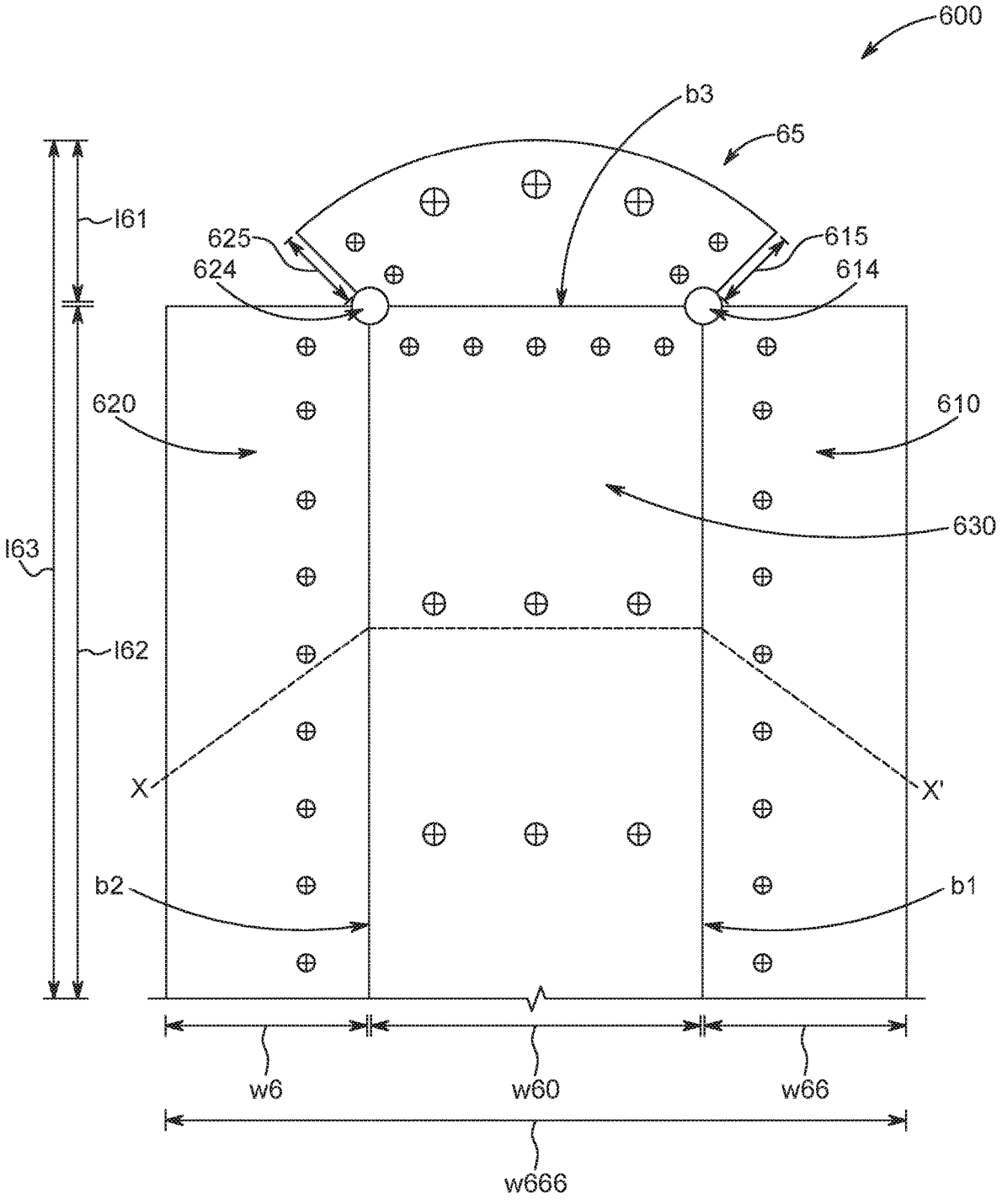
FIG. 13 is a front flat view of the bracket with a flap 600.

FIG. 13 is a flat front perspective view of the bracket with a flap 600. The width w6 of distal end 620 from the second bend line b2 is equal to the width w66 of distal end 610 from the first bend line b1. Bend line b1 and bend line b2 are equidistant from the center portion 630. The width w60 of center portion 630 is equal to the sum of width w6 and width w66. Width w6 of distal end 620 is equal to width w2 of distal end 220 of steel plate 200. Width w66 of distal end 610 is equal to width w22 of distal end 210 of steel plate 200. Width w60 of center portion 630 is equal to the width of w20 of center portion 230 of steel plate 200. Width w666 of bracket with a flap 600 is equal to the width w222 of steel plate 200. The length 162 ranges from twenty-four inches to forty-eight inches. The length 161 ranges from twelve inches to forty-eight inches. The length 163 is equal to the sum of length 162 and length 161. When the bracket with flap 600 is bent on bend line b3, the flap portion 65 is created. The flap portion 65 extends perpendicular to center line 630. Distal end 625 of the flap portion 65 is connected at the intersection of corner 624 of center portion 630 and distal end 620 from the second bend line b2. The length of distal end 625 is determined by the arc of flap 65. Distal end 615 of the flap portion 65 is connected at the intersection of corner 614 of center portion 630 and distal end 610 from the first bend line b1. The length of distal end 615 is determined by the arc of flap portion 65. The bracket with a flap 600 reinforces the top of steel plate 200. Engineering reports determined that the top four feet of the Open End Friction Pile 37 carry the majority of the structural stress. Therefore, it was imperative to reinforce steel plate 200 with the bracket with a flap 600 to reduce or remove structural stress. The flap portion 65 is used for connecting the driving head 24 for installation and also for the top structure connection to the Open End Friction Pile 37.

Figure 14:
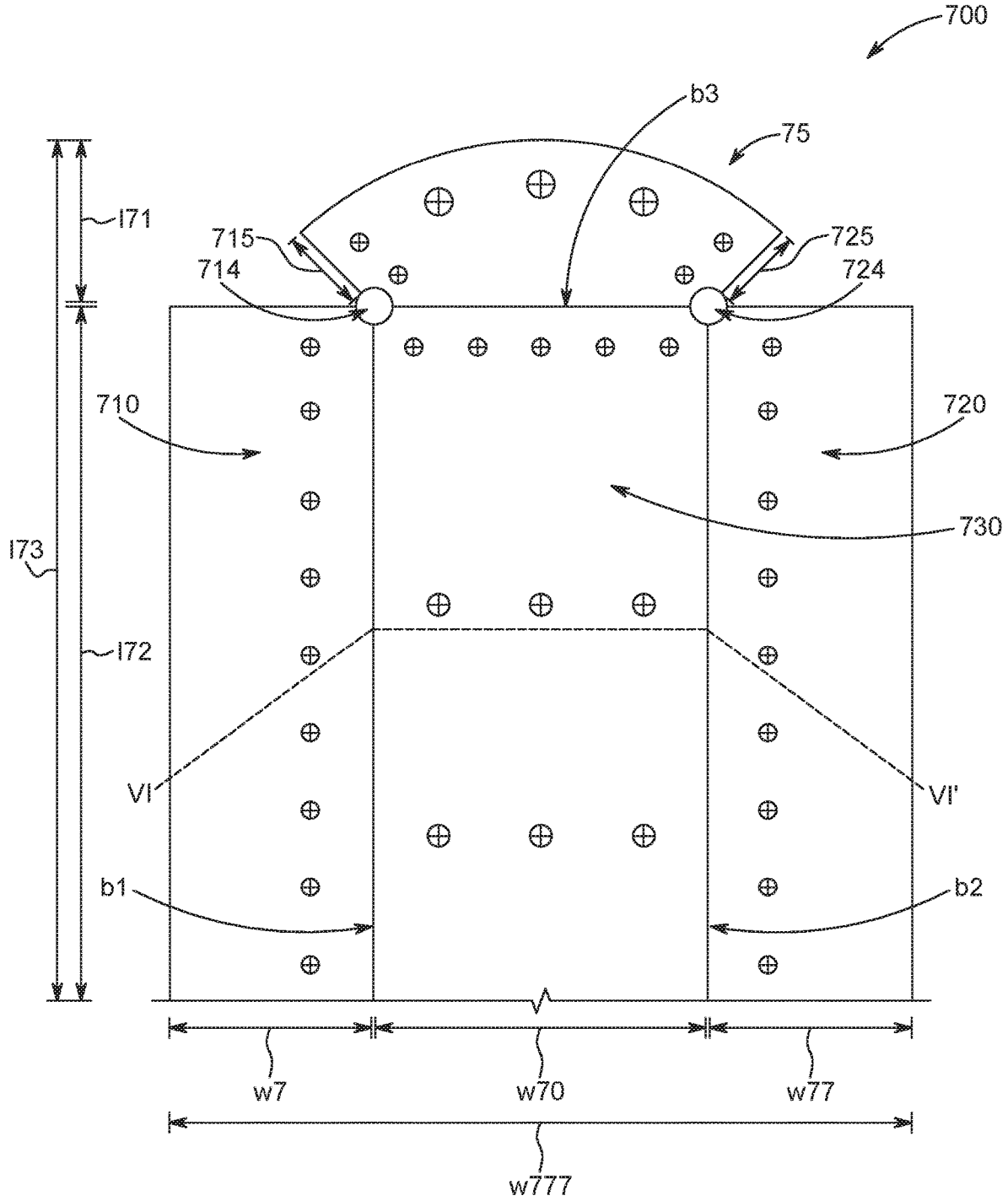
FIG. 14 is a front flat view of the bracket with a flap 700.

FIG. 14 is a flat front perspective view of the bracket with a flap 700. The width w7 of distal end 710 from the first bend line b1 is equal to the width w77 of distal end 720 from the second bend line b2. Bend line b1 and bend line b2 are equidistant from the center portion 730. The width w70 of center portion 730 is equal to the sum of width w7 and width w77. Width w7 of distal end 710 is equal to width w3 of distal end 310 of steel plate 300. Width w77 of distal end 720 is equal to width w33 of distal end 320 of steel plate 300. Width w70 of center portion 730 is equal to the width of w30 of center portion 330 of steel plate 300. Width w777 of bracket with a flap 700 is equal to the width w333 of steel plate 300. The length 172 ranges from twenty-four inches to forty-eight inches. The length 171 ranges from twelve inches to forty-eight inches. The length 173 is equal to the sum of length 172 and length 171. When the bracket with flap 700 is bent on bend line b3, the flap portion 75 is created. The flap portion 75 extends perpendicular to center line 730. Distal end 715 of the flap portion 75 is connected at the intersection of corner 714 of center portion 730 and distal end 710 from the first bend line b1. The length of distal end 715 is determined by the arc of flap 75. Distal end 725 of the flap portion 75 is connected at the intersection of corner 724 of center portion 730 and distal end 720 from the second bend line b2. The length of distal end 725 is determined by the arc of flap portion 75. The bracket with a flap 700 reinforces the top of steel plate 300. Engineering reports determined that the top four feet of the Open End Friction Pile 37 carry the majority of the structural stress. Therefore, it was imperative to reinforce steel plate 300 with the bracket with a flap 700 to reduce or remove structural stress. The flap portion 75 is used for connecting the driving head 24 for installation and also for the top structure connection to the Open End Friction Pile 37.

Figure 15:
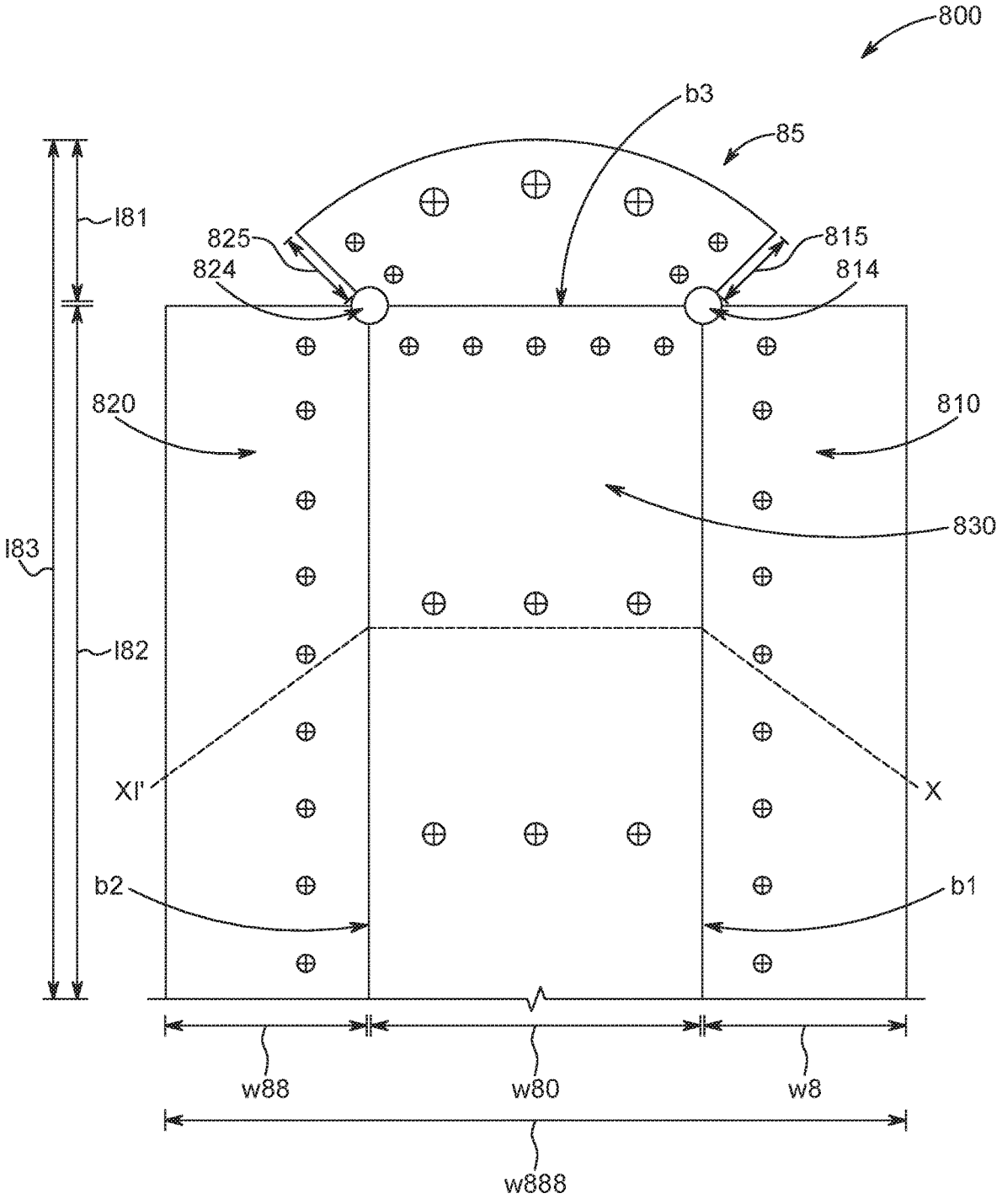
FIG. 15 is a front flat view of the bracket with a flap 800.

FIG. 15 is a flat front perspective view of the bracket with a flap 800. The width w8 of distal end 810 from the first bend line b1 is equal to the width w88 of distal end 820 from the second bend line b2. Bend line b1 and bend line b2 are equidistant from the center portion 830. The width w80 of center portion 830 is equal to the sum of width w8 and width w88. Width w8 of distal end 810 is equal to width w4 of distal end 410 of steel plate 400. Width w88 of distal end 820 is equal to width w44 of distal end 420 of steel plate 400. Width w80 of center portion 830 is equal to the width of w40 of center portion 430 of steel plate 400. Width w888 of bracket with a flap 800 is equal to the width w444 of steel plate 400. The length 182 ranges from twenty-four inches to forty-eight inches. The length 181 ranges from twelve inches to forty-eight inches. The length 183 is equal to the sum of length 182 and length 181. When the bracket with flap 800 is bent on bend line b3, the flap portion 85 is created. The flap portion 85 extends perpendicular to center line 830. Distal end 815 of the flap portion 85 is connected at the intersection of corner 814 of center portion 830 and distal end 810 from the first bend line b1. The length of distal end 815 is determined by the arc of flap portion 85. Distal end 825 of the flap portion 85 is connected at the intersection of corner 824 of center portion 830 and distal end 820 from the second bend line b2. The length of distal end 825 is determined by the arc of flap portion 85. The bracket with a flap 800 reinforces the top of steel plate 400. Engineering reports determined that the top four feet of the Open End Friction Pile 37 carry the majority of the structural stress. Therefore, it was imperative to reinforce steel plate 400 with the bracket with a flap 800 to reduce or remove structural stress. The flap portion 75 is used for connecting the driving head 24 for installation and also for the top structure connection to the Open End Friction Pile 37.

Figure 16:
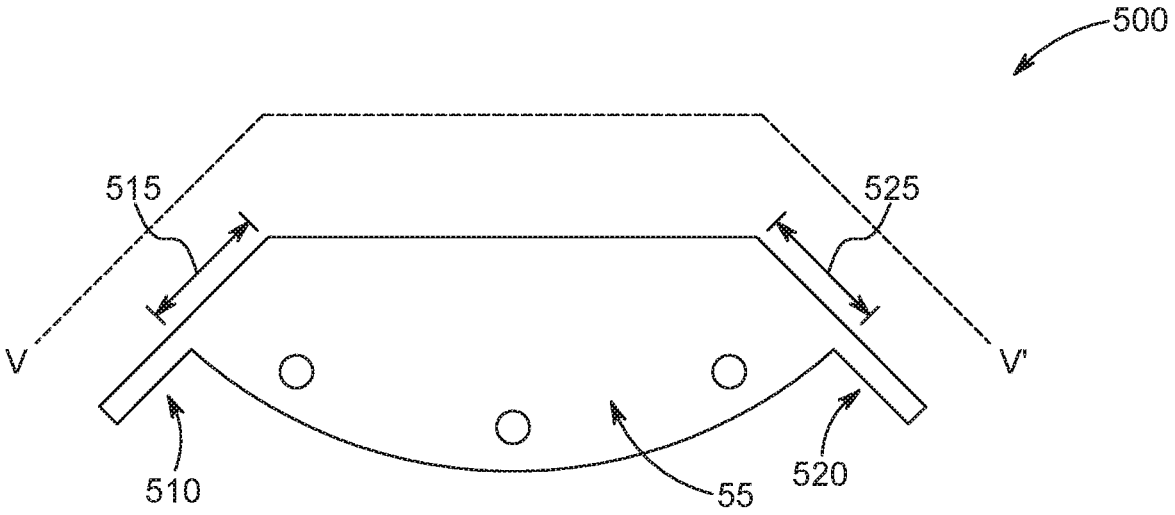
FIG. 16 is a top perspective view according to FIG. 12.

FIG. 16 is a top cross-sectional view of bracket with a flap 500, taken along line V-V' of FIG. 12. Furthermore, FIG. 16 illustrates that distal end portion 515 of flap portion 55 connects to distal end 510. FIG. 16 also illustrates that distal end portion 525 of flap portion 55 connects to distal end 520.

Figure 17:
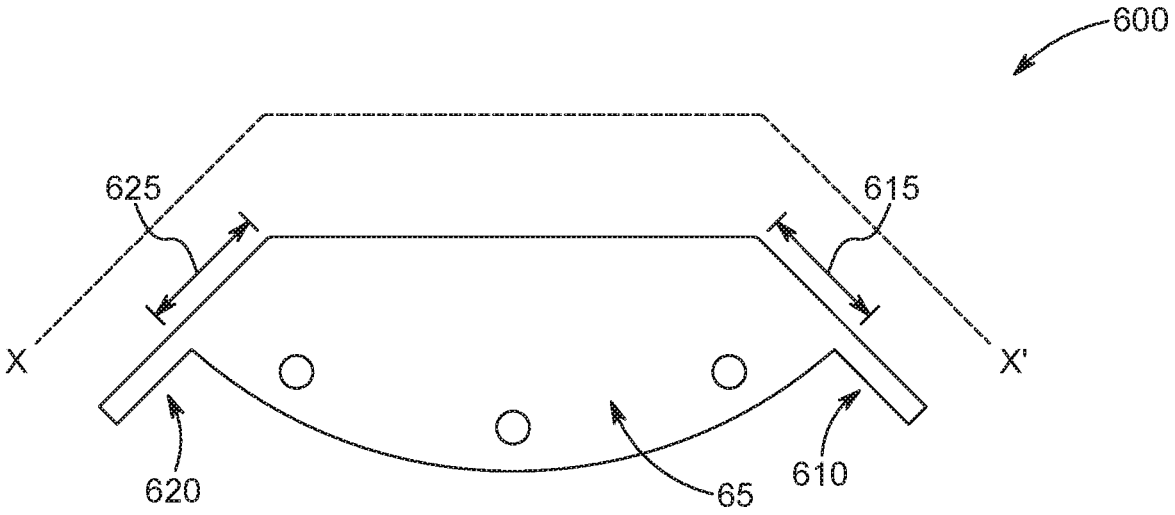
FIG. 17 is a top perspective view according to FIG. 13.

FIG. 17 is a top cross-sectional view of bracket with a flap 600, taken along line X-X' of FIG. 13. Furthermore, FIG. 17 illustrates that distal end portion 625 of flap portion 65 connects to distal end 620. FIG. 17 also illustrates that distal end portion 615 flap portion 65 connects to distal end 610.

Figure 18:
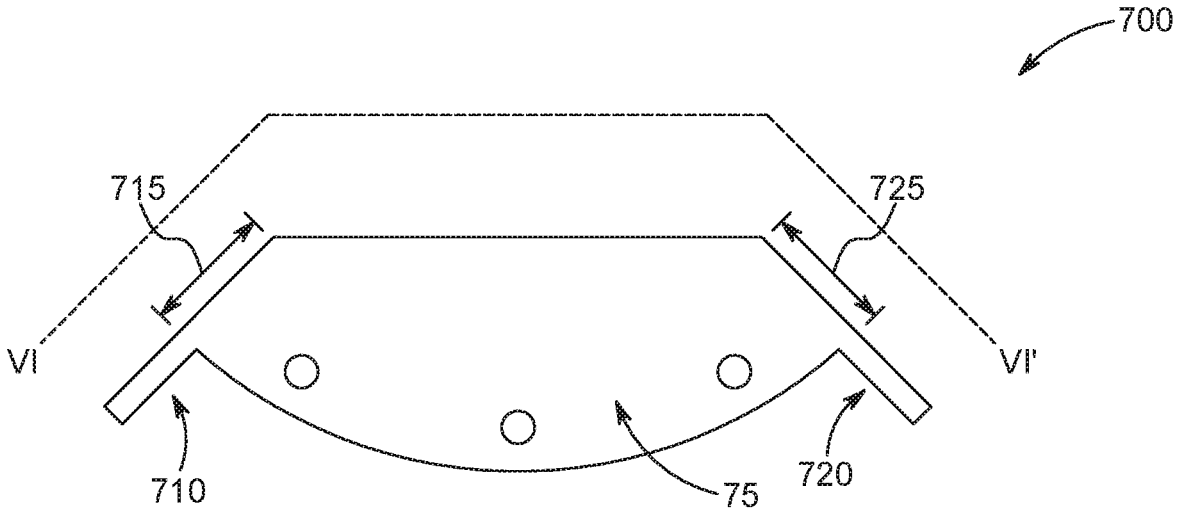
FIG. 18 is a top perspective view according to FIG. 14.

FIG. 18 is a top cross-sectional view of bracket with a flap 700, taken along line VI-VI' of FIG. 14. Furthermore, FIG. 18 illustrates that distal end portion 715 of flap portion 75 connects to distal end 710. FIG. 18 also illustrates that distal end portion 725 of flap portion 75 connects to distal end 720.

Figure 19:
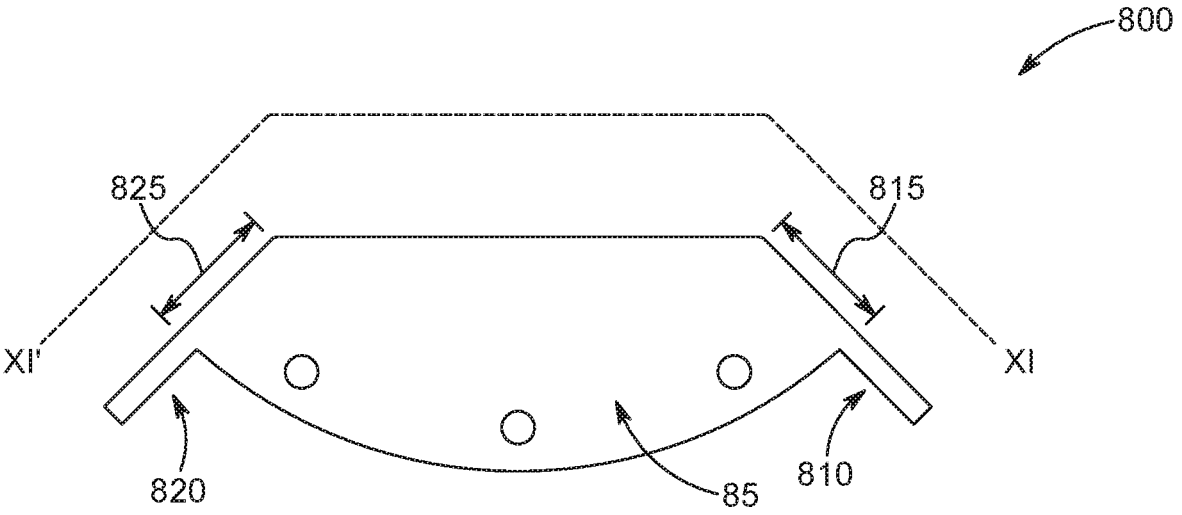
FIG. 19 is a top perspective view according to FIG. 15.

FIG. 19 is a top cross-sectional view of bracket with a flap 800, taken along line XI'-XI of FIG. 15. Furthermore. FIG. 19 illustrates that distal end portion 825 of flap portion 85 connects to distal end 820. FIG. 19 also illustrates that distal end portion 815 of flap portion 85 connects to distal end 810.

Figure 20:
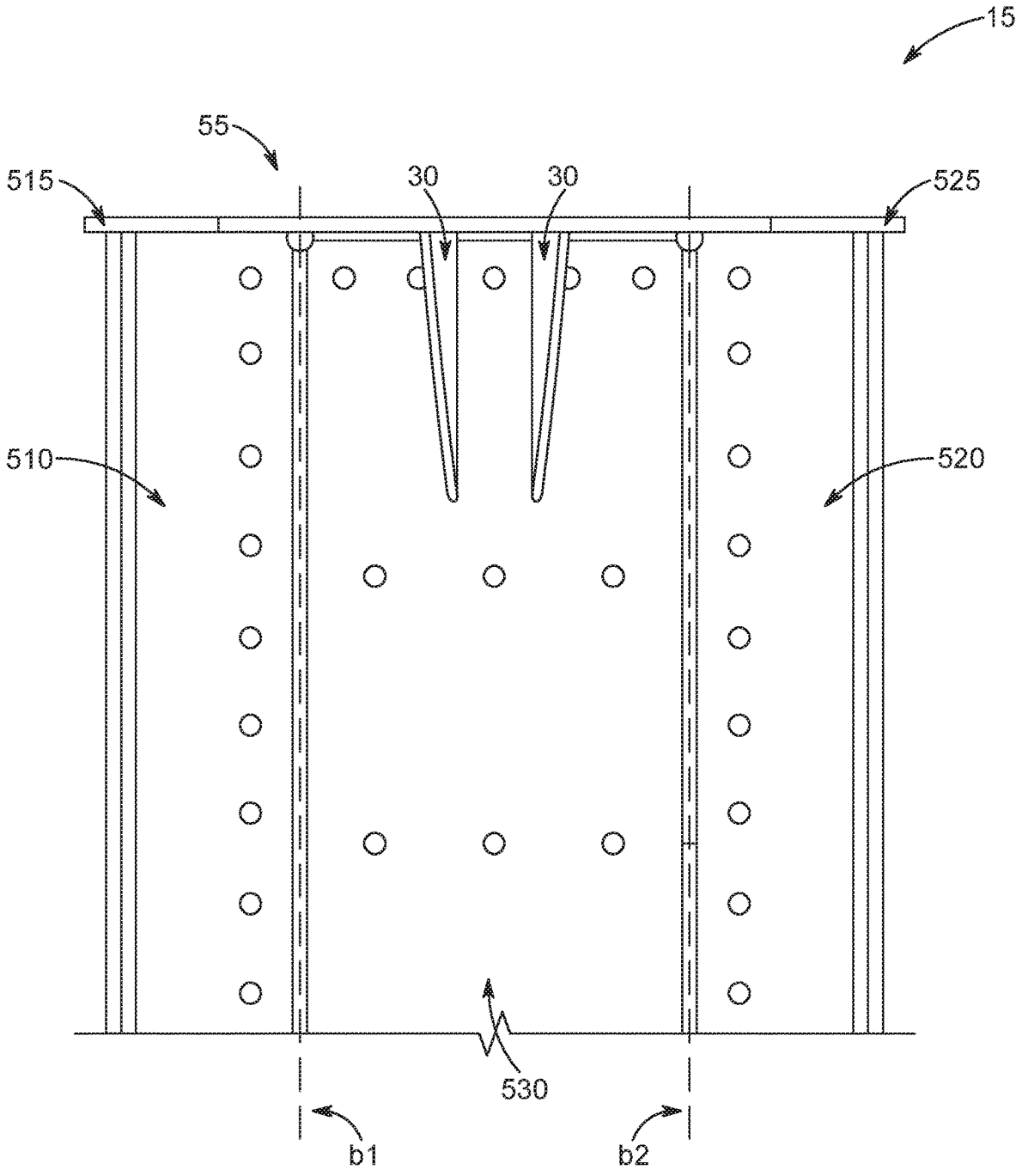
FIG. 20 is a front view of the bent bracket with flap 15 according to FIG. 12.

FIG. 20 is a front view of the formed bracket with a flap 15, according to FIG. 12, with attached gussets 30. Two gussets 30 connect the flap portion 55 to the center portion 530 of bracket with a flap 500. The two gussets 30 are used for additional strength during installation. Mobilrams are capable of applying up to 750 TON. The gussets 30 keep flap portion 55 from bending downward or being pulled backward during installation.

Figure 21:
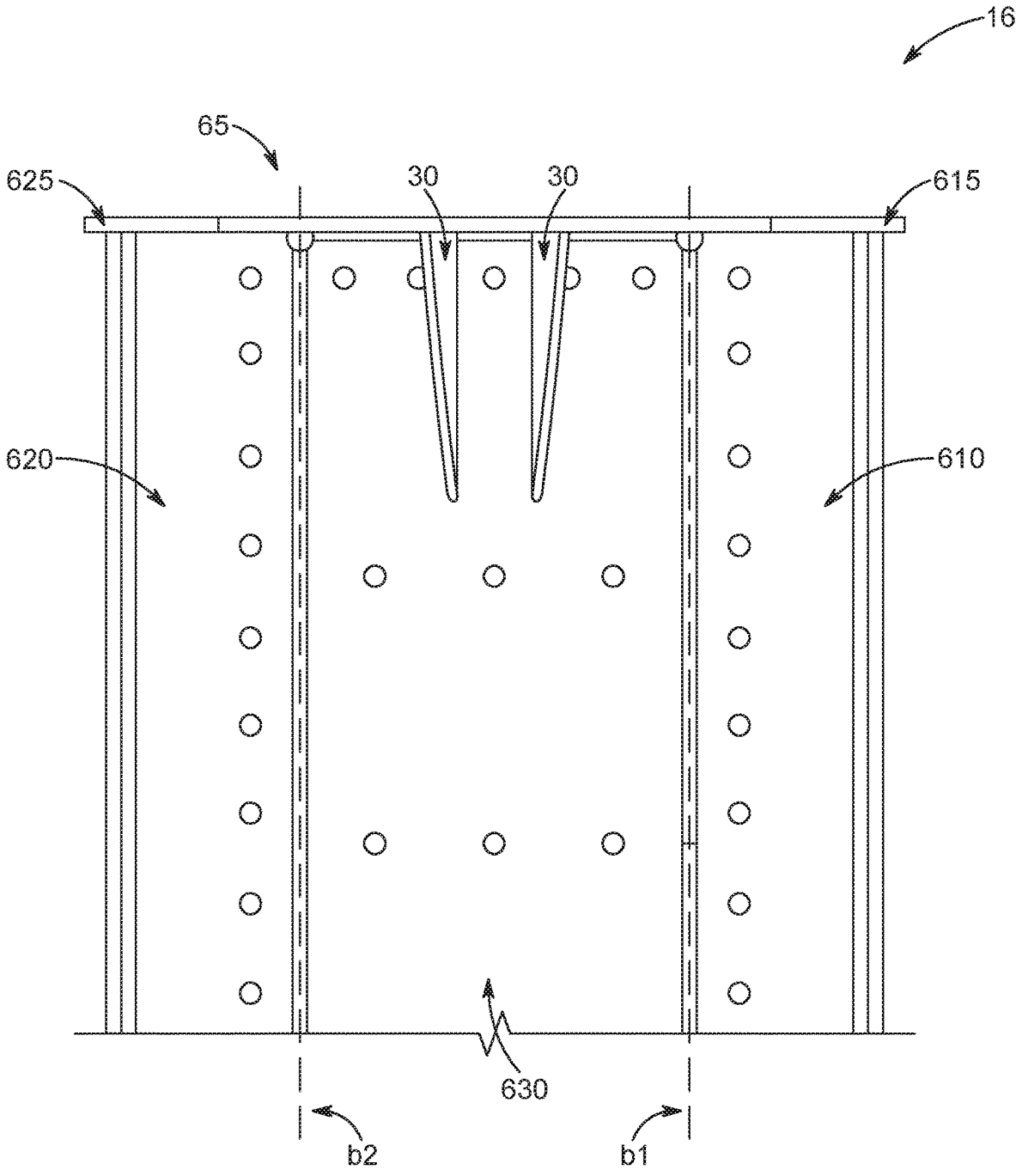
FIG. 21 is a front view of the bent bracket with flap 16 according to FIG. 13.

FIG. 21 is a front view of the formed bracket with a flap 16, according to FIG. 13, with attached gussets 30. Two gussets 30 are connecting the flap portion 65 to the center portion 630 of bracket with a flap 600. The gussets 30 are used for additional strength during installation. Mobilrams are capable of applying up to 750 TON. The gussets 30 keep flap portion 65 from bending downward or being pulled backward during installation.

Figure 22:
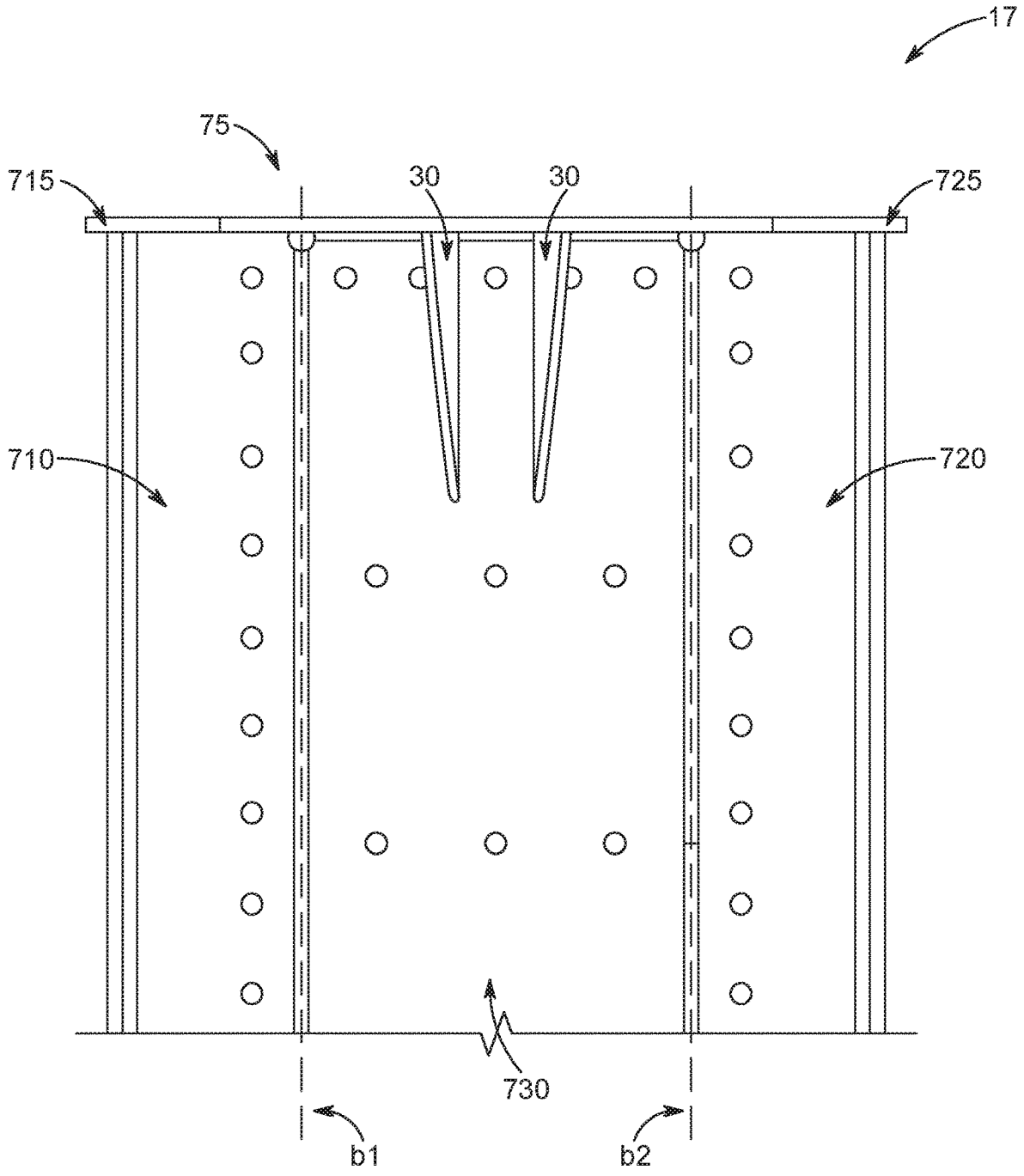
FIG. 22 is a front view of the bent bracket with flap 17 according to FIG. 14.

FIG. 22 is a front view of the formed bracket with a flap 17, according to FIG. 14, with attached gussets 30. Two gussets 30 are connecting the flap portion 75 to the center portion 730 of bracket with a flap 700. The gussets 30 are used for additional strength during installation. Mobilrams are capable of applying up to 750 TON. The gussets 30 keep flap portion 75 from bending downward or being pulled backward during installation.

Figure 23:
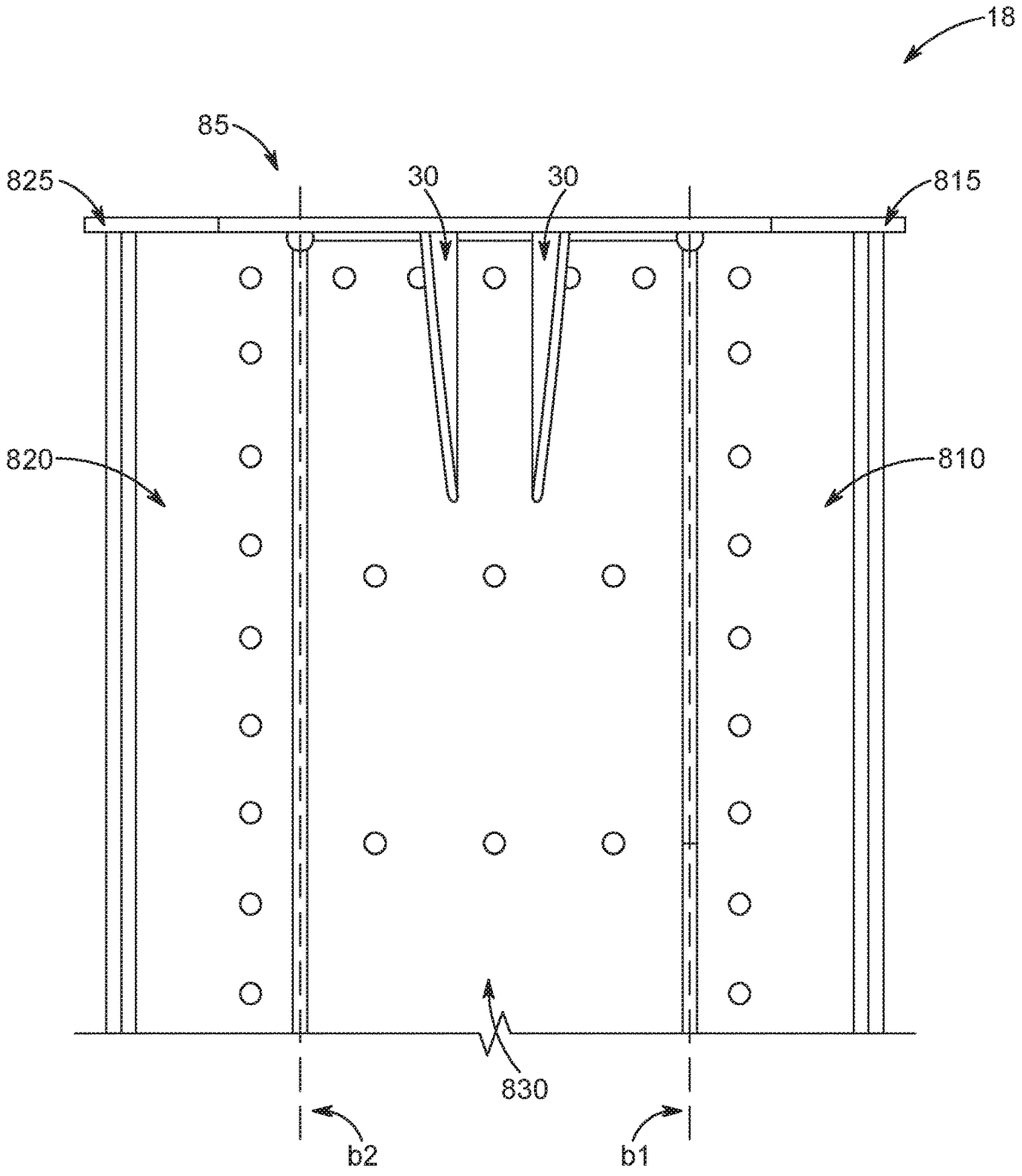
FIG. 23 is a front view of the bent bracket with flap 18 according to FIG. 15.

FIG. 23 is a front view of the formed bracket with a flap 18, according to FIG. 15, with attached gussets 30. Two gussets 30 connect flap portion 85 to center portion 830 of bracket with a flap 800. The gussets 30 are added for additional strength during installation. Mobilrams are capable of applying up to 750 TON. The gussets 30 keep flap portion 85 from bending downward or being pulled backward during installation.

Figure 24:
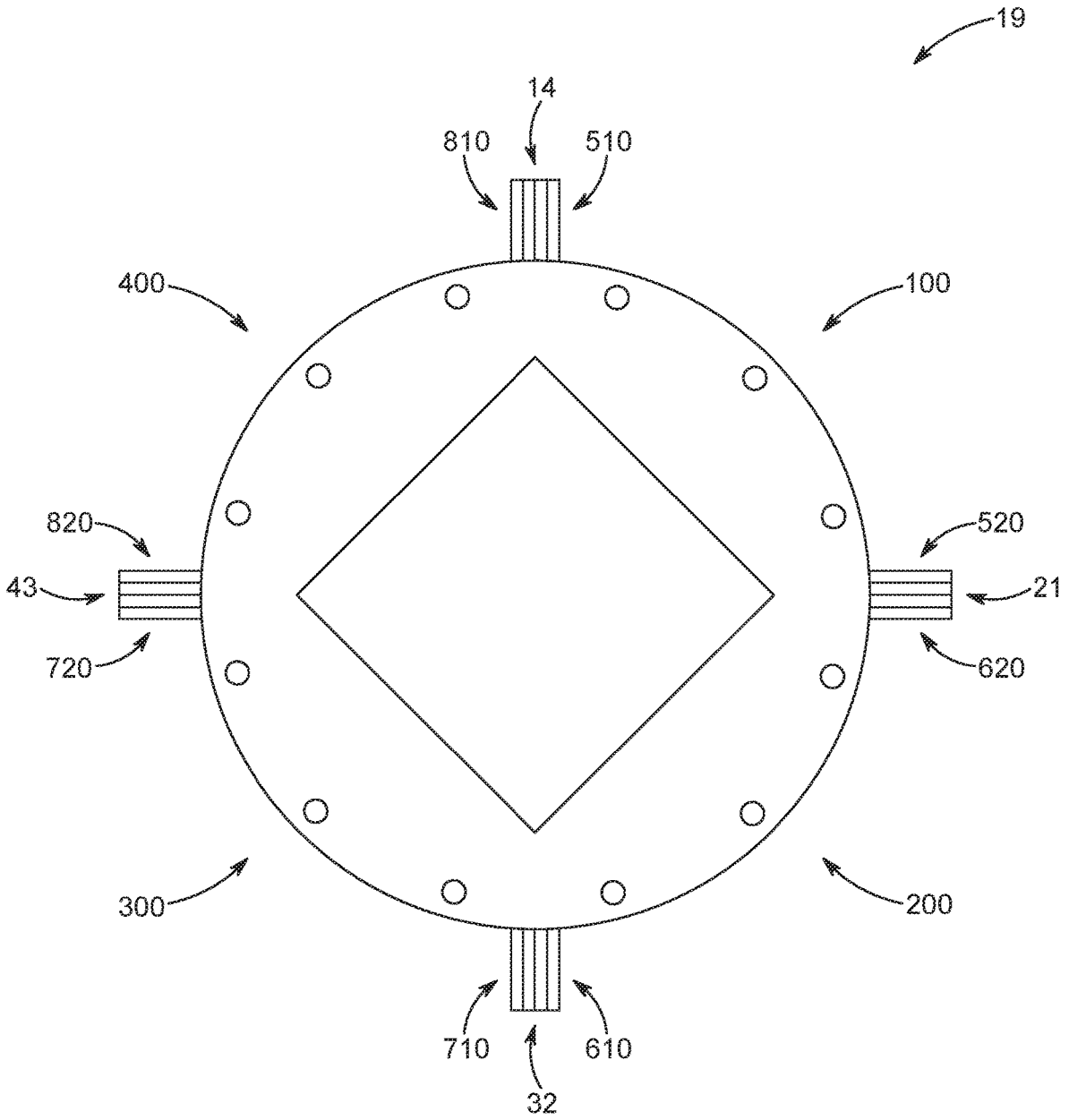
FIG. 24 is a top perspective view of the bent bracket with flap 19 according to FIG. 12.

FIG. 24 is a top perspective view 19 according to FIG. 20, FIG. 21, FIG. 22, and FIG. 23. FIG. 24 illustrates the flush connection of distal end 520 to distal end 120 of steel plate 100 and the flush connection of distal end 620 to distal end 220 of steel plate 200 forming side 21. FIG. 24 illustrates the flush connection of distal end 510 to distal end 110 of steel plate 100 and the flush connection of distal end 810 to distal end 410 of steel plate 400 forming side 14. FIG. 24 illustrates the flush connection of distal end 820 to distal end 420 of steel plate 400 and the flush connection of distal end 720 to distal end 320 of steel plate 300 forming side 43. FIG. 24 illustrates the flush connection of distal end 710 to distal end 310 of steel plate 300 and the flush connection of distal end 610 to distal end 210 of steel plate 200 forming side 32.

Figure 25:
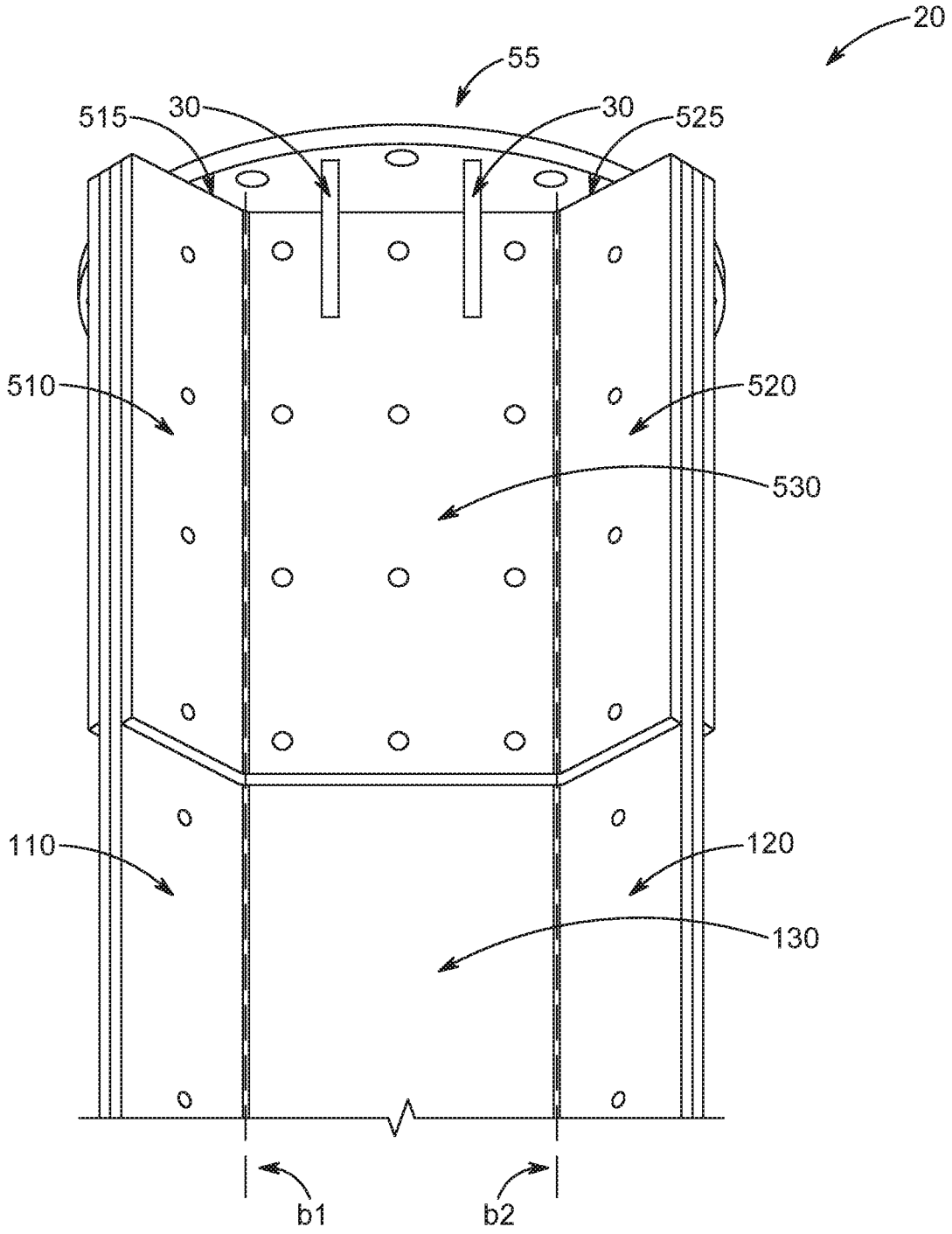
FIG. 25 is a bottom perspective view of the bent bracket with flap 20 according to FIG. 20 connecting to steel plate 100 according to FIG. 2.

FIG. 25 is a front view 20 according to FIG. 2 and FIG. 12. FIG. 25 illustrates the connection of distal end 510 from the first bend line b1 of the bracket with a flap 500 to distal end 110 from the first bend line b1 of steel plate 100. FIG. 25 illustrates the connection of distal end 520 from the second bend line b2 of the bracket with a flap 500 to distal end 120 from the second bend line b2 of steel plate 100. FIG. 25 illustrates center portion 530, which is equidistant from the first bend line b1 and the second bend line b2 of the bracket with a flap 500, connecting to center portion 130 that is equidistant from the first bend line b1 and the second bend line b2 of steel plate 100. The two gussets 30 connect to the flap portion 55 and to center portion 530.

Figure 26:
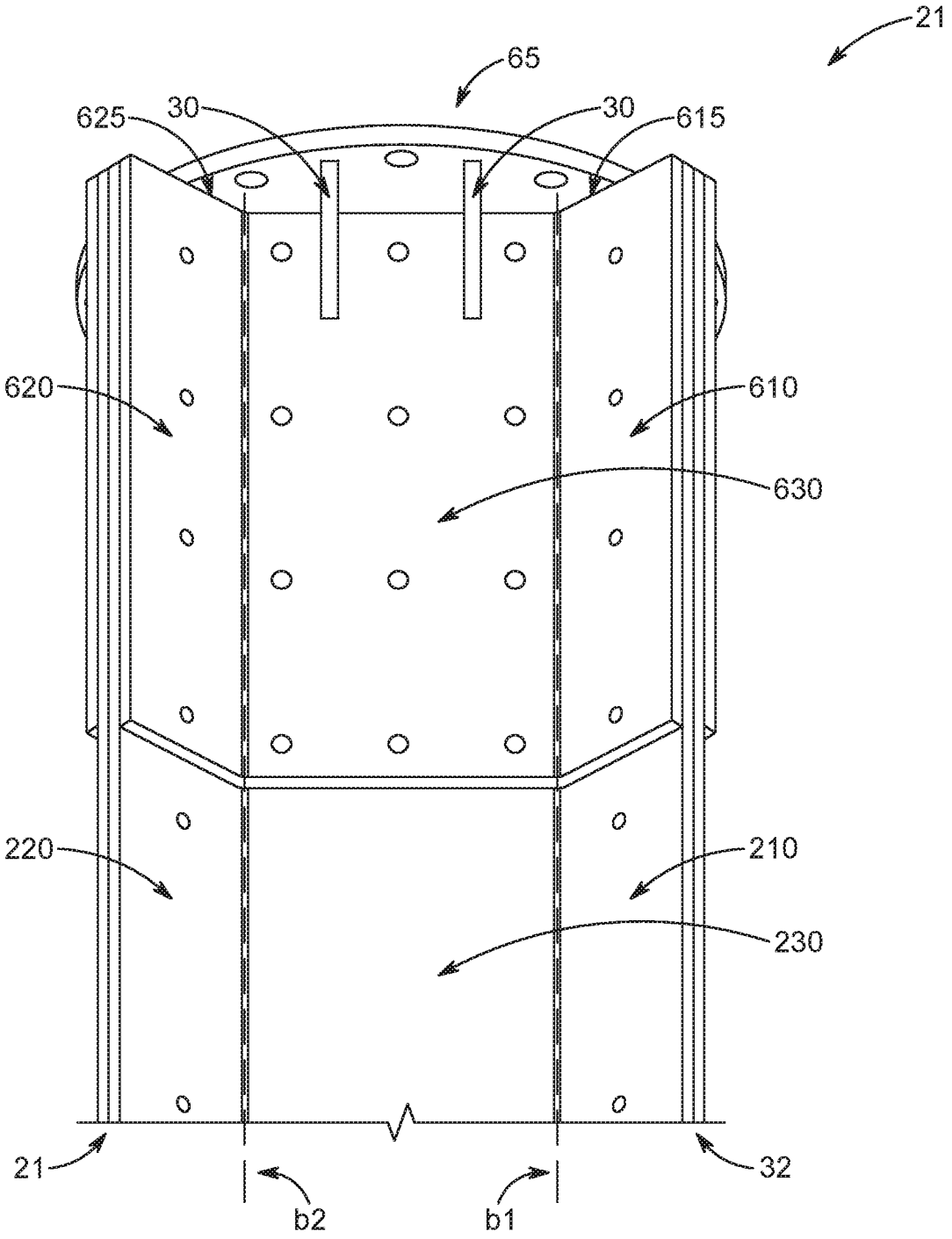
FIG. 26 is a bottom perspective view of the bent bracket with flap 21 according to FIG. 21 connecting to steel plate 200 according to FIG. 3.

FIG. 26 is a front view 21 according to FIG. 3 and FIG. 13. FIG. 26 illustrates the connection of distal end 620 from the second bend line b2 of the bracket with a flap 600 to distal end 220 from the second bend line b2 of steel plate 200. FIG. 26 illustrates the connection of distal end 610 from the first bend line b1 of the bracket with a flap 600 to distal end 210 from the first bend line b1 of steel plate 200. FIG. 26 illustrates center portion 630, which is equidistant from the second bend line b2 and the first bend line b1 of the bracket with a flap 600, connecting to center portion 230 that is equidistant from the second bend line b2 and the first bend line b1 of steel plate 200. The two gussets 30 connect to the flap portion 65 and to center portion 630.

Figure 27:
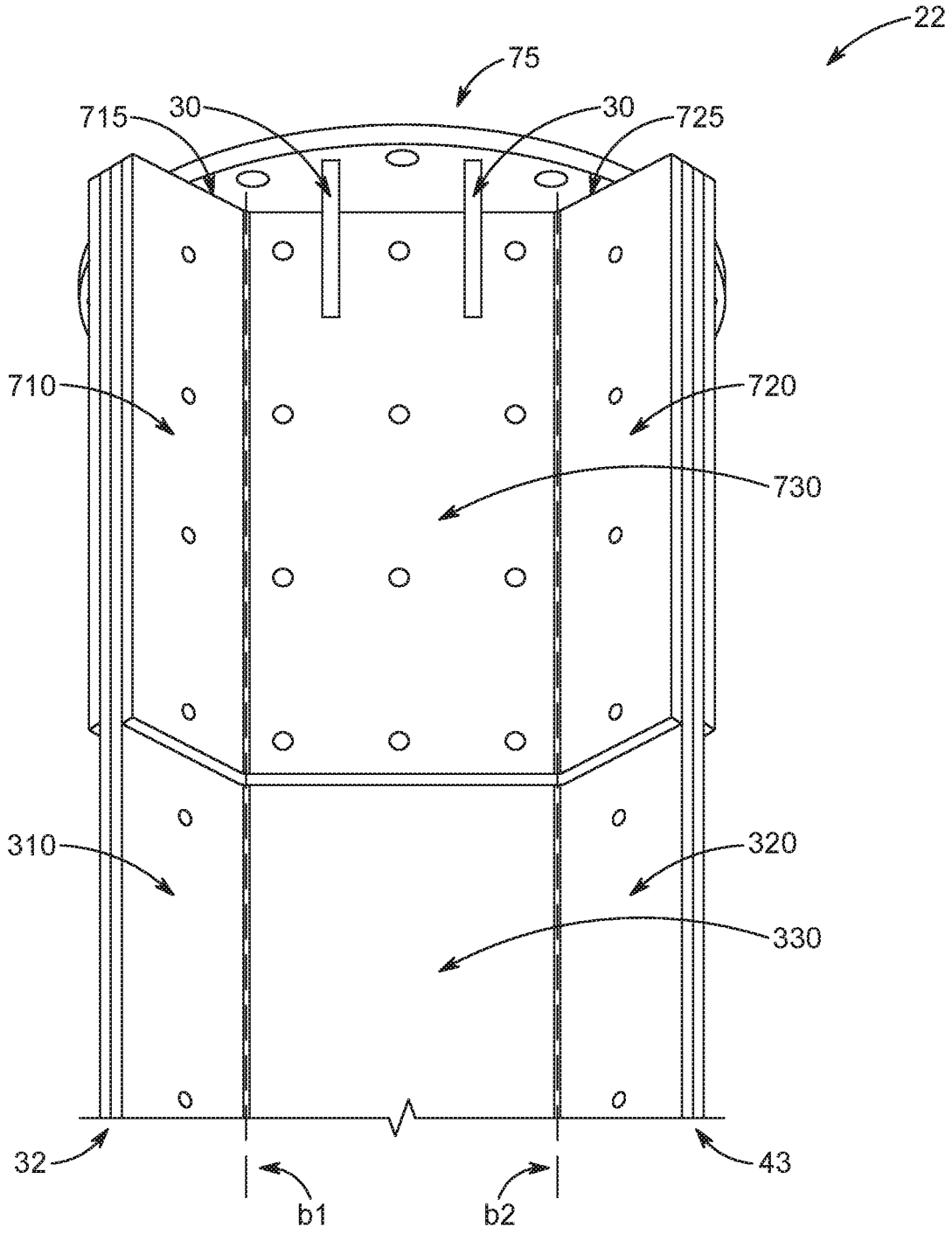
FIG. 27 is a bottom perspective view of the bent bracket with flap 22 according to FIG. 22 connecting to steel plate 300 according to FIG. 4.

FIG. 27 is a front view 22 according to FIG. 4 and FIG. 14. FIG. 27 illustrates the connection of distal end 710 from the first bend line b1 of the bracket with a flap 700 to distal end 310 from the first bend line b1 of steel plate 300. FIG. 27 illustrates the connection of distal end 720 from the second bend line b2 of the bracket with a flap 700 to distal end 320 from the second bend line b2 of steel plate 300. FIG. 27 illustrates center portion 730, which is equidistant from the first bend line b1 and the second bend line b2 of the bracket with a flap 700, connecting to center portion 330 that is equidistant from the first bend line b1 and the second bend line b2 of steel plate 300. The two gussets 30 connect to the flap portion 75 and to center portion 730.

Figure 28:
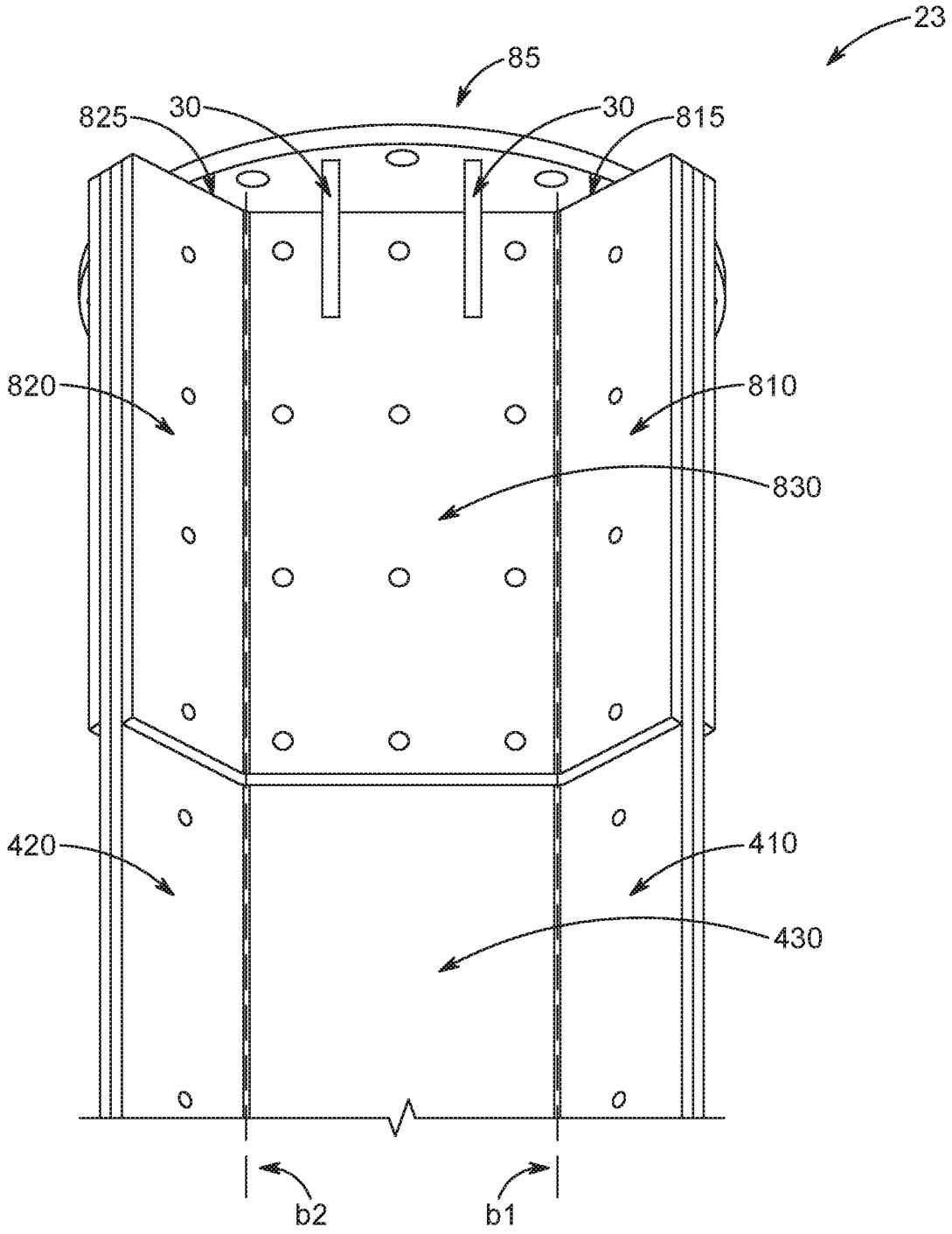
FIG. 28 is a bottom perspective view of the bent bracket with flap 23 according to FIG. 23 connecting to steel plate 400 according to FIG. 5.

FIG. 28 is a front view 22 according to FIG. 5 and FIG. 15. FIG. 28 illustrates the connection of distal end 820 from the second bend line b2 of the bracket with a flap 800 to distal end 420 from the second bend line b2 of steel plate 400. FIG. 28 illustrates the connection of distal end 810 from the first bend line b1 of the bracket with a flap 800 to distal end 410 from the first bend line b1 of steel plate 400. FIG. 28 illustrates center portion 830, which is equidistant from the second bend line b2 and the first bend line b1 of the bracket with a flap 800, connecting to center portion 430 that is equidistant from the second bend line b2 and the first bend line b1 of steel plate 400. The two gussets 30 connect to the flap portion 85 and to center portion 830.

Figure 29:
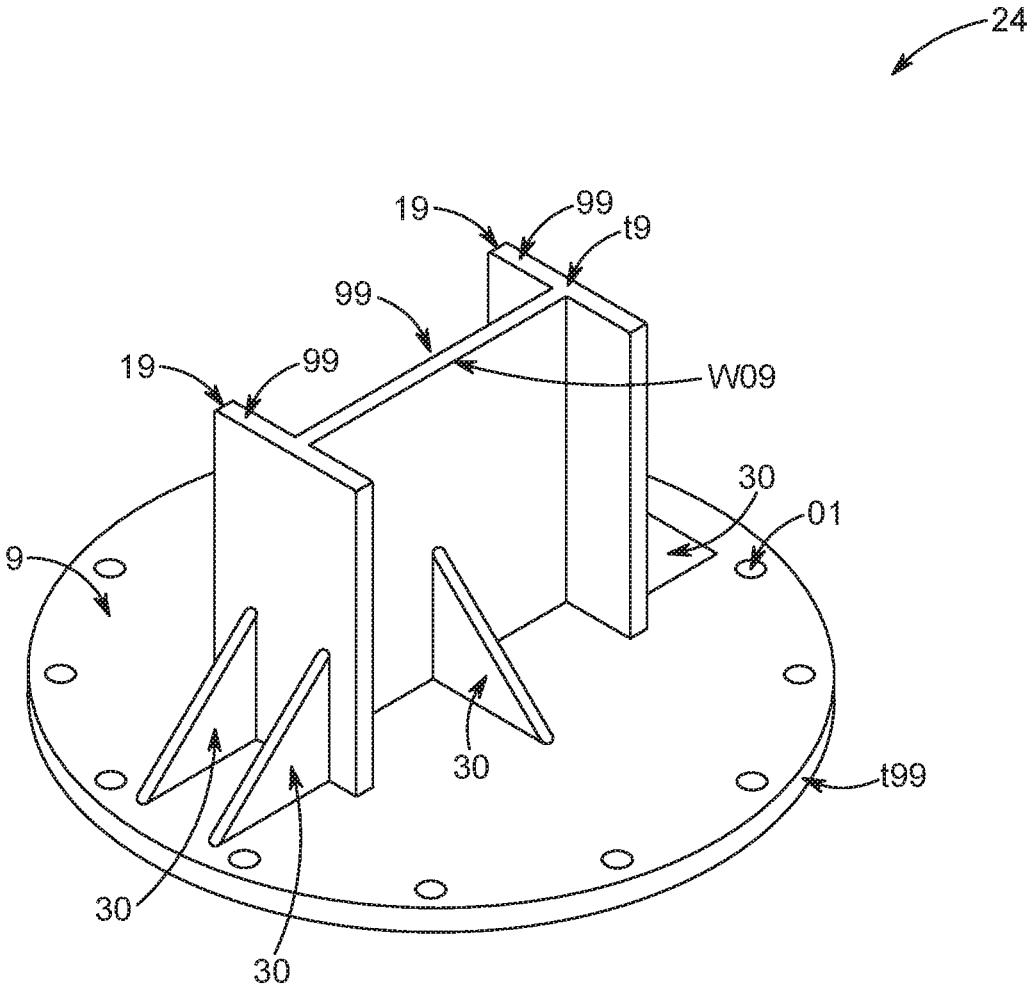
FIG. 29 is a top perspective view of the driving head 24 according to FIG. 1.

FIG. 29 is a top perspective view of the driving head 24. FIG. 29 illustrates an H-Beam 99 connected by gussets 30 to the circular steel plate 9. The driving head 24 shows circular holes 01 for the mechanical fastener connection between the driving head 24 and flap portions. The H-Beam 99 is clamped by the Mobilram attachment to lift the Open End Friction Pile 37 from a delivery truck and to install the pile. The gussets 30 connect to the H-Beam 99 and to the circular steel plate 9. The thickness t9 of the H-Beam webbing w09 is determined by the tonnage required for installation. The higher the tonnage, the thicker the webbing w09 of the H-Beam 99. The circular steel plate 9 is manufactured by placing flat steel on a plasma table and using the appropriate die cut to fabricate the circular steel plate 9. The thickness t99 of circular steel plate 9 can range from one-half inch to four inches in thickness. The diameter of circular steel plate 9 is determined by the arc of the flap portions.

Figure 30:
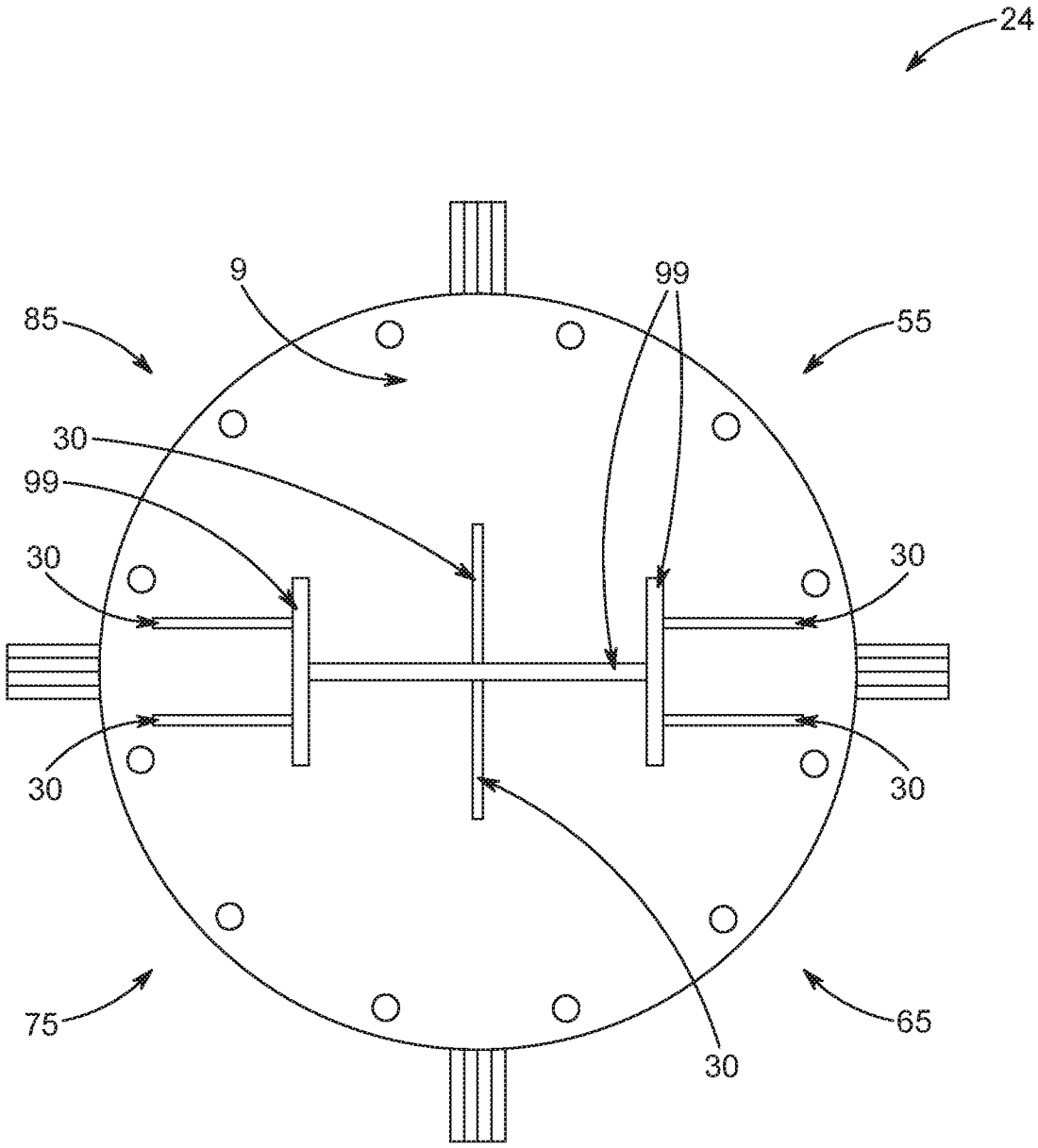
FIG. 30 is a top view of the driving head 24 according to FIG. 1.

FIG. 30 is a top view of the driving head 24 according to FIG. 29. FIG. 30 illustrates that the driving head 24 is connected and completely covers the bracket with a flap 15, bracket with a flap 16, bracket with a flap 17, and bracket with a flap 18. FIG. 30 further illustrates that the driving head 24 connects and complete covers the distal ends according to FIG. 16, FIG. 17, FIG. 18, and FIG. 19. The driving head 24 connects to the brackets with a flap and their respective distal end portions while those distal end portions and center portions of the brackets with a flap connect to the distal ends and center portions of the steel plates to create the Open End Friction Pile 37 according to FIG. 1.

Figure 31:
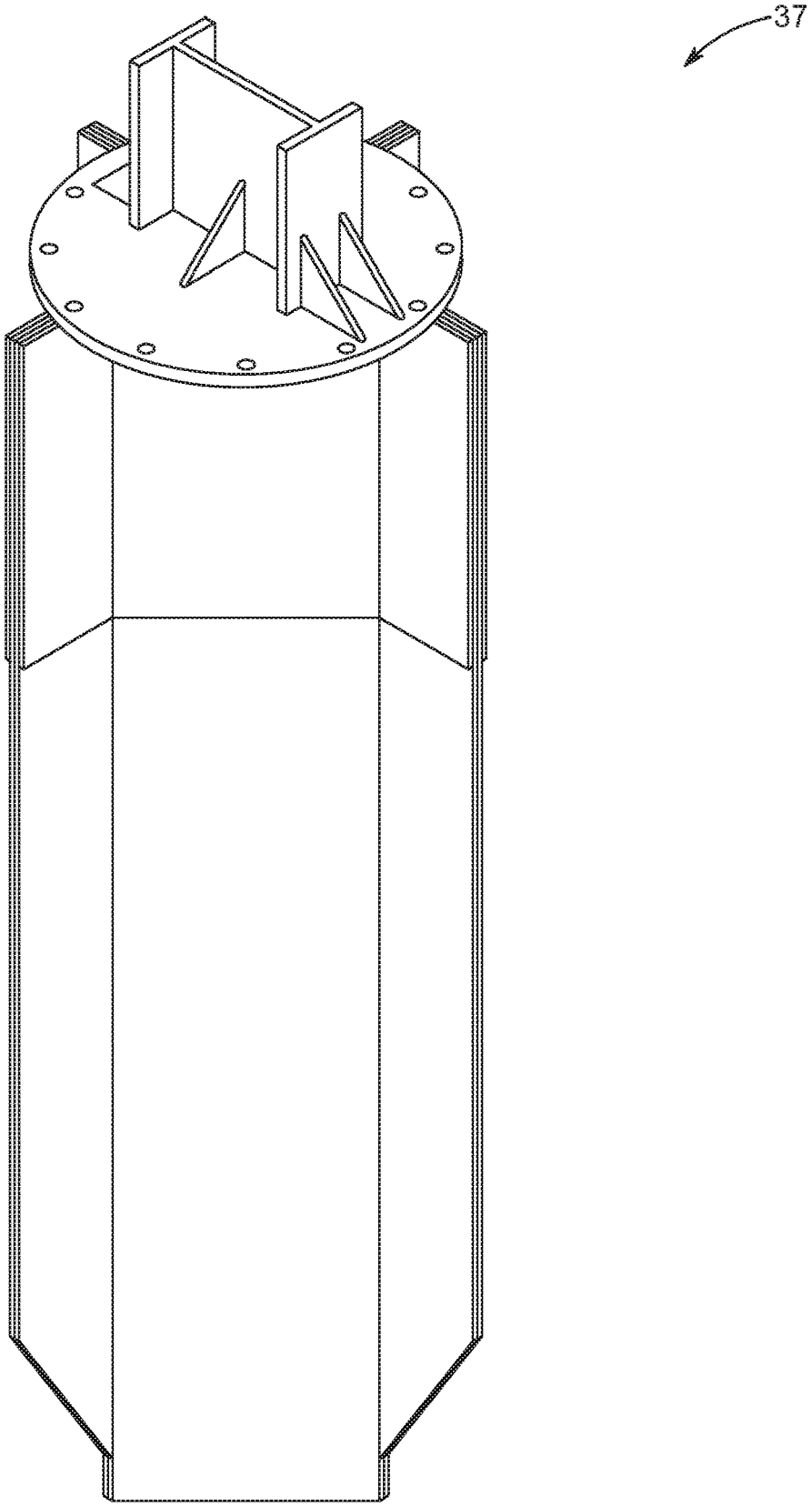
FIG. 31 is a perspective view of the Open End Friction Pile 37 according to FIG. 1.

FIG. 31 is a perspective view of the Open End Friction Pile 37 according to FIG. 1.

The invention claimed is:

1. A method of installing a support structure, comprising: providing a friction pile comprising:

a three-dimensional structure having an open bottom end and being defined by a plurality of pile plates, a plurality of brackets, and a driving head, the plurality of pile plates each having a first distal end, a second distal end, and a center portion between the first and second distal ends, the first distal end of each of the pile plates connected to the second distal end of another pile plate, each of the plurality of brackets comprising, a first distal end, a second distal end, a center portion between the first and second distal ends, a first bend line between the first distal end and the center portion; and a second bend line between the second distal end and the center portion, the first bend line and the second bend line each extend vertically the full length of the bracket, the plurality of brackets each being connected to one of the plurality of pile plates, the driving head being connected to the plurality of brackets; and a driving head connected to the three-dimensional structure and having a vertical plate and at least one gusset extending from the vertical plate;

clamping the friction pile via the driving head with a ram; and applying a force to the driving head to force the friction pile into the ground, such that soil enters the open bottom end of the three-dimensional structure.

2. The method according to claim 1, further comprising vibrating the driving head concurrently with applying the force to the driving head.

3. The method according to claim 1, wherein the force is applied hydraulically.

4. The method according to claim 1, wherein providing the friction pile comprises connecting the driving head to the three-dimensional structure via mechanical fasteners.

5. The method according to claim 1, wherein the driving head of the friction pile comprises an H-Beam structure configured to be clamped by the ram.

6. The method according to claim 1, wherein forcing the friction pile into the ground generates friction between the between the friction pile and the soil.

7. The method according to claim 1, wherein the soil entering the open bottom end of the three-dimensional structure forms a soil plug inside the three-dimensional structure.

8. The method according to claim 7, further comprising continuing to apply the force to the driving head until the friction reaches a desired penetration depth.

9. The method according to claim 1, wherein forcing the friction pile into the ground generates soil friction on an inside wall of the three-dimensional structure.

10. The method according to claim 1, wherein the driving head of the friction pile comprises a base plate covering a top end of the three-dimensional structure, and wherein the vertical plate extends from the base plate in a direction opposite the three-dimensional structure.

11. The method according to claim 10, wherein the driving head comprises two end plates and wherein the vertical plate extends from one of the end plates to the other of the end plates.

12. The method according to claim 11, wherein the driving head further comprises one or more gussets extending from the two end plates to the base plate.

13. The friction pile according to claim 10, wherein the base plate of the driving head defines a plurality of circular holes for receiving mechanical fasteners for connecting the driving head to the three-dimensional structure.

14. The method according to claim 1, wherein each of the plurality of pile plates comprises:

a first bend line between the first distal end and the center portion; and a second bend line between the second distal end and the center portion, wherein the first bend line and the second bend line each extend vertically the full length of the pile plate, and wherein the distance from the first bend line to the first distal end is equal to the distance from the second bend line to the second distal end.

15. The method according to claim 1, wherein each of the plurality of brackets further comprises a flap extending horizontally along a third bend line across the first distal end, the second distal end, and the center portion of the bracket.

* * * * *